US006619573B2

(12) United States Patent
Arterburn et al.

(10) Patent No.: US 6,619,573 B2
(45) Date of Patent: Sep. 16, 2003

(54) CHOPPER FOR CUTTING FIBER CONTINUOUSLY, AND METHOD

(75) Inventors: Russell Donovan Arterburn, Athens, TN (US); Randall Clark Bascom, Wauseon, OH (US)

(73) Assignee: Johns Manville International, Inc., Denver, CO (US)

( * ) Notice: Subject to any disclaimer, the term of this patent is extended or adjusted under 35 U.S.C. 154(b) by 59 days.

(21) Appl. No.: 09/935,266

(22) Filed: Aug. 22, 2001

(65) Prior Publication Data

US 2003/0037647 A1 Feb. 27, 2003

(51) Int. Cl.[7] ..... B02C 4/30
(52) U.S. Cl. ..... 241/30; 241/235; 241/294
(58) Field of Search ..... 241/294, 235, 241/236, 30; 492/4, 30, 35, 36, 59; 29/895.23, 895.21, 402.03, 426.5, 426.6

(56) References Cited

U.S. PATENT DOCUMENTS 3,000,585 A 9/1961 Sokal
3,090,105 A * 5/1963 Gibbar et al. ..... 241/294
3,460,221 A * 8/1969 Korsch ..... 492/4
4,045,196 A 8/1977 Schaefer
4,083,279 A 4/1978 Wester et al.
5,072,504 A * 12/1991 Thompson ..... 29/426.6

* cited by examiner

*Primary Examiner*—Mark Rosenbaum
(74) *Attorney, Agent, or Firm*—Robert D. Touslee

(57) ABSTRACT

A chopper for chopping items such as fibers, fiber strands, ribbon, etc. by passing the items continuously in a loose, unwound, condition through the nip of a blade roll and a backup roll having a working layer on its outer periphery. The chopper of the present invention uses one or more rolls that are radially expandable and retractable to replace the blade roll and/or the backup roll on the prior art choppers so that worn blades and/or a worn working layer can be more quickly and more easily replaced with a new or repaired working layer or blade holder containing sharp blades. The chopper of the present invention eliminates the need to carry large, heavy, awkward rolls through the fiber forming rooms or areas where the items are being chopped and also to transport such rolls back and forth to the location where they are being rebuilt. Instead only lightweight working layers or blade holders are carried to and from the choppers and such are installed on the choppers with much reduced downtime than heretofore necessary.

14 Claims, 18 Drawing Sheets

CHOPPER FOR CUTTING FIBER CONTINUOUSLY, AND METHOD

The present invention pertains to an improved apparatus such as a chopper for chopping strands such as mineral fiber like fiber glass, synthetic fibers like polyester or polyethylene and natural fibers like hemp and cotton, or for cutting wire, ribbon, string and like materials, and the method of using the apparatus, particularly to cut fibers continuously at high speed. In the improved chopper of the present invention, the cot or backup roll elastomer material, which is preferably polyurethane, and the blade holder can be replaced much faster and easier than was heretofore possible.

In processes of making chopped fiber of various kinds, a chopper receives continuously one or more loose, unwound strands, each made up of a plurality of fibers and chops the strand(s) into short lengths generally ranging from about ⅛th inch to 3 or more inches long. The strand(s) are often moving very fast through the chopper, typically at several thousand feet per minute, but also slower at hundreds of feet per minute. Examples of such a process are the processes of making chopped glass fiber as disclosed in U.S. Pat. Nos. 3,508,461, 3,771,701, 3,815,461, 3,869,268, 4,175,939, 4,249,441, 4,347,071, 4,373,650, 4,398,934, 4,411,180, 4,551,160, 4,576,621, and 4,840,755, which references are incorporated herein by reference.

As chopping time progresses, blade edges and the elastomeric working surface layer of a backup roll on the chopper deteriorate to the point that the chopper does not chop cleanly and "double cuts" or incomplete cuts are produced, i.e. one or more individual fibers are not cut leaving the chopped pieces linked together with one or more fibers. Incomplete cuts are unacceptable because they significantly reduce product quality by causing defects in products made from the chopped fiber. Therefore, just prior to the elapsed time where incomplete cuts can no longer be avoided or where other factors such as vibration become serious, the chopper is shut down and the old cot roll or backup roll and/or the old blade roll are removed and replaced with rebuilt or new backup and/or blade rolls. This procedure requires at least 5–8 minutes and frequently more time, especially when it is necessary to replace another part on the chopper. Also, the rolls, particularly the large backup rolls are very heavy and hard to carry or manipulate in the fiberizing rooms. In some cases, the old backup and blade rolls are shipped hundreds of miles to have a new working layer cast on the metal wheels.

While the chopper is shut down for rebuild or repair, the fiber continues to issue from the fiberizing bushings on the line serviced by the chopper and must be sent to the basement as scrap, since it is impractical to stop the bushings from fiberizing. Also, the thermal balance on the fiberizing tips of the bushings are impacted negatively when the chopper is shut down because less external air is drawn into the tip area by the slow moving fibers as compared to when the chopper is pulling the fibers at thousands of feet per minute. This condition causes the thermal equilibrium of the bushing to be disturbed, and causes the glass exiting the tips to change temperature. If a chopper is down for more than a few minutes, this will cause the strand to break out (caused by fibers breaking) numerous times for many minutes after the chopper is back on line. This condition is sometimes referred to as "false starts" and this undesirable situation results in a significant reduction in fiberizing efficiency, i.e. a percentage obtained by dividing the weight of good fiber produced in a given period of time by the weight of molten glass that exited the bushings in the same period of time.

Overheated bushings caused by chopper down times of 5 minutes or more can reduce fiber efficiency significantly for 10–20 minutes or more after the chopper is restarted and chopping fiber strands again. Also, while the bushings are "hanging", i.e. not fiberizing at high strand speed, such as when the strands are not being pulled at a speed of at least 1000 feet/minute by the chopper, etc., the melt rate of the bushings that are "hanging" changes significantly which changes the pull rate on the melter and upsets the equilibrium of the melter reducing glass quality and fiberizing efficiency.

The chopper has to be rebuilt on a regular basis and the time between rebuilds will vary depending on the diameter of the fiber being chopped, the type of chemical sizing on the surface of the fiber (most contain lubricants and binders that complicate chopping), the condition of the chopper, the speed of chopping, and the quality of the lowest quality portion of the lowest quality blade edge or backup roll working layer. Typical life times of blade rolls/backup rolls are in the range of 6–48 hours, depending on the type of fiber being chopped as explained above. A chopper typically services about 8–15 bushings, each putting out 100 or more pounds of fiber per hour, 24 hours per day, 7 days per week and 364 or 365 days per year. A typical fiber plant will have 8–20 choppers operating. Chopper down time typically costs at least ten dollars per minute per chopper. It can be readily seen that substantially reducing the down time of the choppers during rebuilds or repair will have a substantial positive financial impact on the operation.

This problem of substantial downtime of fiberization due to rebuilds of the choppers has persisted for many years in spite of the very substantial financial incentive to reduce or eliminate the problem and still persists in the industry. Very recently an indexing chopper was developed which greatly reduces downtime required to replace a cot or backup roll and this is disclosed in U.S. Pat. No. 5,970,837. While this latter invention greatly reduces the downtime of that type of chopper, there remain many non-indexing choppers. Also, the backup and blade rolls are becoming larger in diameter and heavier in an attempt to achieve longer lives of the working parts. These large and heavy backup and blade rolls on the indexing and other prior art choppers cause a handling problem, often requiring mechanical lift assist equipment. Because lift assist devices are awkward to use in the limited space around a chopper in fiber forming rooms, there is a substantial resistance to their use. As a result, lifting injuries can result and the risk is significant in spite of good lifting policies. The time required to replace the back up and blade rolls on all choppers and the difficulty of doing so would be substantially reduced if the weight of the back up and blade rolls could be reduced substantially. But, their size and weight has been increasing in the past several years.

Chopper back up rolls currently have an elastomer working layer or band that is cast directly onto a heavy, metal hub of the backup roll and then machined to a smooth surface off line before the rebuilt backup roll is mounted onto a chopper in the fiber forming room after another backup roll with a worn elastomer working portion is removed from the chopper. The worn elastomer working portion on the heavy hub is then machined off line and outside the fiber forming room to produce a smooth surface for reuse, or is removed entirely from the heavy hub and wheel after which a new band of elastomer is cast onto the heavy hub and dressed, again outside the forming room. Often the heavy rolls are shipped to a remote location, sometimes hundreds of miles away, to have a new polyurethane working layer cast on the rim of each heavy roll. A typical back up roll with a new elastomer working portion weighs about 45–70 pounds and a back up roll having an elastomer working portion that is so worn that it needs to be replaced weighs about 40–60 pounds. Most of this weight is the heavy, metal hub as the new elastomer band typically weighs only about 15–30 pounds.

Another way of making a back up roll is to press or stretch an elastomer band of rubber or polyurethane or other suitable elastomeric material over the outer circumferential surface of a heavy wheel and then mount the heavy roll onto the chopper as before described. Stretching the band of elastomer over the periphery of the heavy hub must be done outside the fiber forming room because of the large size of the equipment needed to accomplish this stretching, positioning and releasing task. Regardless of which method of making new or conditioned back up rolls is used, all suffer the disadvantages of having to maintain several heavy hubs for each chopper and to have to carry heavy hubs into and out of the fiber forming room to rebuild the choppers.

The blade rolls of choppers are taken to a shop outside the forming or fiberizing room where they are taken apart, the worn blades removed, and new or resharpened blades are installed. After being put back together, the heavy blade rolls are then reinstalled on a chopper. Most of the weight of these prior art blade and backup rolls is due to a heavy hub and wheel. The thermoplastic or elastomeric blade holder or elastomeric working layers are relatively lightweight.

Due to space limitations in the fiber forming rooms, the fact that most fiber plants have at least 16–20 or more choppers per plant and the fact that back up rolls have gotten progressively larger and heavier with optimization of the fiber choppers, maintaining the back up rolls on the choppers has become a difficult and costly task.

BRIEF SUMMARY OF THE INVENTION

The invention includes a chopper for chopping items selected from the group consisting of one or more fiber, fiber strand, yarn, string, wire, ribbon, and tape that enter the chopper in an unwound form at a high linear speed into an array of short lengths. The chopper comprises a frame supporting a blade roll mounted on a first spindle and containing a set of spaced apart blades mounted in an outer periphery of the blade roll, a backup roll mounted on a second spindle and having a working surface layer as its outer periphery, the blades on the blade roll and the working layer on the backup roll forming a nip where the items are chopped. The improvement comprises the use of a blade roll, a backup roll or both rolls that are expandable and retractable radially to permit a working surface or a blade holder to be replaced as an outer periphery without having to remove either the backup roll or the blade roll from the chopper.

The present invention also includes a method of separating various items into short segments comprising running items selected from the group consisting of one or more fiber, fiber strand, yarn, string, wire, ribbon, and tape into a chopper in an unwound form at a high linear speed thus producing an array of short segments, the chopper comprising a frame supporting a blade roll mounted on a first spindle and containing a set of spaced apart blades mounted in an outer periphery of the blade roll, a backup roll mounted on a second spindle and having a working surface layer as its outer periphery, the improvement comprising wherein either the blade roll, the backup roll or both are expandable and retractable radially to permit a working surface or a blade holder to be replaced as an outer periphery without having to remove either the backup roll or the blade roll from the chopper.

The chopper of the present invention, having a novel back up roll or blade roll, allows the working surface on the back up roll, usually an elastomer layer, and/or the blade holder on the blade roll to be removed from the heavy hub quickly and easily inside the forming room followed by easy and fast replacement with a new or a reconditioned, machined, working layer and/or a blade holder containing new or resharpened blades, both tasks requiring no complex, heavy or bulky equipment. This is possible because of the unique wheel(s) and inventive roll(s) used on the chopper of the present invention. The unique wheels forming the basis for the inventive rolls used in the present invention as the new back up and blade rolls contain either movable mechanical members, inflatable/deflatable members or both to expand and retract the outer circumferential periphery of the expandable/retractable wheels (ER wheels) on the chopper of the present invention. The inflatable/deflatable wheels of the present invention have one or more inflatable/deflatable pouches for moving a plurality of flight bars radially. The outer surface of a plurality of flight bars is expanded against the inner periphery of either the working layer or the blade holder to hold one or both during the chopping operation. The contact surfaces of either the flight bars, the working layer and blade holder, or all can be textured or shaped in a wide variety of ways to secure upon contact in a manner to guarantee against relative movement of the opposing contact surfaces.

The heavy, metal, ER wheels with hubs need not be removed from the chopper unless they become damaged, or require other maintenance like replacing bushings or bearings, which is very infrequent. Thus, it is only necessary to have one or two heavy, metal, expandable/retractable backup roll and blade roll wheels per chopper compared to more than six to ten backup rolls per chopper as currently practiced.

With the present invention the worn working layer and/or blade holder can be removed and the new or reconditioned working layer and/or blade holder containing new blades replaced in a fraction of the time required to remove the worn back up roll and blade roll and replace them with new or reconditioned back up roll and blade roll as the prior art practices, thus resulting in substantially less time required to refresh or rebuild the chopper. The new and reconditioned elastomer bands and blade holders weigh only a fraction of the weight of the same mounted on the heavy back up roll and blade rolls and thus can be carried into and out of the forming rooms much more quickly and easily than prior art rolls. This significantly improves productivity in the fiber forming rooms and significantly reduces the difficulty and chances of a muscle or back strain by the people rebuilding choppers.

The expandable/retractable back up and blade rolls of the present invention can be of various structures and can be totally mechanical, fluid operated or a combination of mechanical and fluid operated. Preferably the wheels have positive stops that limit the movement of the outer periphery of the hub to insure proper diameter and roundness of the back up roll and also have positive stops to prevent any significant retraction of any portion of the wheel during operation.

DETAILED DESCRIPTION OF THE INVENTION

Figure 1:
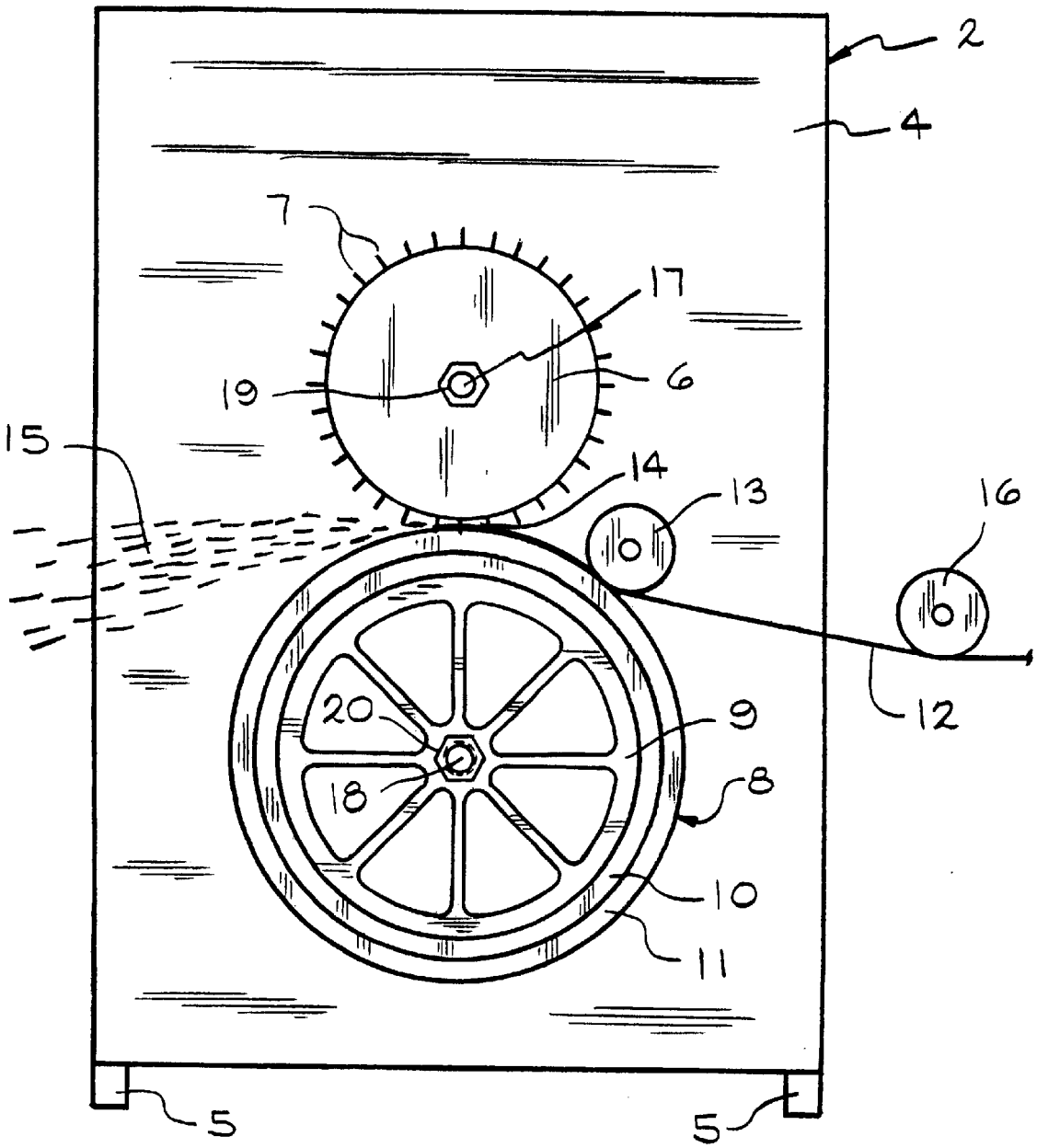
FIG. 1 PRIOR ART
FIG. 1 is a front elevational view of a prior art chopper having a horizontal discharge of chopped fiber strands.

FIG. 1 shows a front elevation view of a typical prior art chopper 2 used in making chopped strand glass fiber. It comprises a frame and front plate 4, feet 5, a blade roll 6 with spaced apart blades 7 contained in slots and projecting from the periphery of a blade holder integrated into the blade roll 6, a backup roll 8 and an idler roll 13. The blade roll 6 is mounted on a rotatable spindle 17 and held in place with a large nut 19. The blade roll 6 is usually made of metal and thermoplastic material such as the blade rolls shown in U.S. Pat. Nos. 4,083,279, 4,249,441 and 4,287,799, the disclosures of which are herein incorporated by reference.

The backup roll 8 is comprised of a hub and spoke assembly 9 with an integral metal rim 10 on which is cast or mounted a working layer 11 of an elastomer or thermoplastic material such as polyurethane. The backup roll 8 is mounted on a second spindle 18 and held in place with a large nut 20. In operation the blades 7 of the blade roll 6 press into the working layer 11 of the backup roll 8 forming a nip 14 to break or separate fiber strands 12 into an array of short lengths.

One or more, usually eight or more and up to 20 or more strands 12, such as glass fiber strands, each strand containing 400–6000 or more fibers and usually having water and/or an aqueous chemical sizing on their surfaces, are pulled by the backup roll 8, in cooperation with a knurled idler roll 13, into the chopper 2 and the nip 14. The strands 12 first run under a grooved oscillating, separator and guide roll 16, preferably with one or two strands in each groove, and upward and over the outer surface of the backup roll 8. The working surface of the back up roll 8 is typically wider than the oscillating path of the glass fiber strands 12. The strands 12 then pass under the outer knurled surface of the idler roll 13, which is pressed against the strands at a desired pressure to enable pulling of the glass fiber strands. The strands remain on the surface of the working layer 11 and next pass into the nip 14 between the backup roll 8 and the blade roll 6 where they are separated with the razor sharp blades 7 wherein the strands are usually cleanly cut or broken into an array of chopped strand 15 having the desired length.

Figure 2:
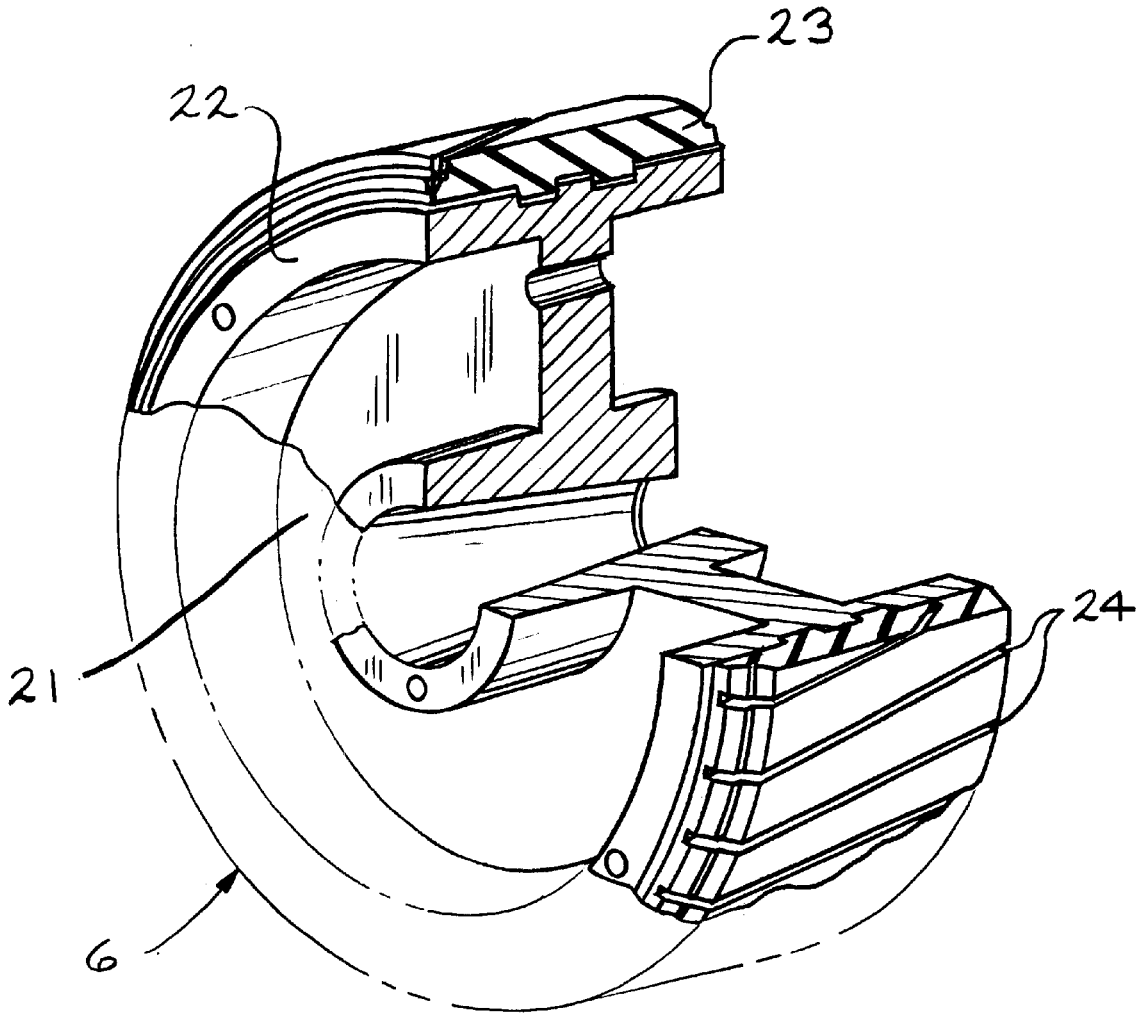
FIG. 2 PRIOR ART
FIG. 2 is a partially cut away perspective rear view of a blade roll (without the blades) for the chopper.

FIG. 2 shows a typical blade roll 6 in more detail. This prior art blade roll is disclosed in complete detail in U.S. Pat. No. 4,083,279, which disclosure is incorporated herein by reference. The blade roll 6 comprises a heavy metal hub 21, an integral heavy metal rim 22 and a blade holder member 23 having slots 24 to hold the blades. The blade retainer means adds further weight to the blade roll 6. While typically not as large or heavy as the backup roll 8, nevertheless the blade rolls are heavy and awkward to handle because of the need to avoid the sharp blades that are dangerously sharp even when needing to be replaced.

When the chopper is shut down to replace the blade roll or backup roll, the production from the line of bushings serviced by that chopper will be lost for usually at least about 8 minutes and additional production will be lost because of lower than normal fiberizing efficiency for a significant time period, the amount depending on how long the chopper was down, after the chopper is started back up. The amount of production lost due to lower fiberizing efficiency is dependent upon how long the chopper is down.

The present invention allows a shut down time of only a minute or two, producing a large increase in productivity compared to a shutdown of 5–8 minutes or longer, and has a very positive effect on melter and molten glass stability and consistency. The present invention also overcomes the workload of having to remove the very heavy backup roll 8 and the heavy blade roll 6 and the undesirable task of having to replace them with another blade roll 6 having new blades 7 therein and an even heavier backup roll 8 having a new or reconditioned working layer 11.

The present invention includes apparatus for, and provides a method of, replacing the working portions of a backup roll and a blade roll without removing either roll from the chopper comprising using a retractable/expandable wheel (RD wheel) such as an inflatable/deflatable wheel (ID wheel) on at least one of the backup and/or blade rolls. This is done by retracting the outer portion of the ID wheel, removing only the worn working layer or blade holder from the hub assembly, placing a new or repaired working portion or blade holder on the RD or ID wheel and expanding the wheel to a positive stopped position.

Figure 3:
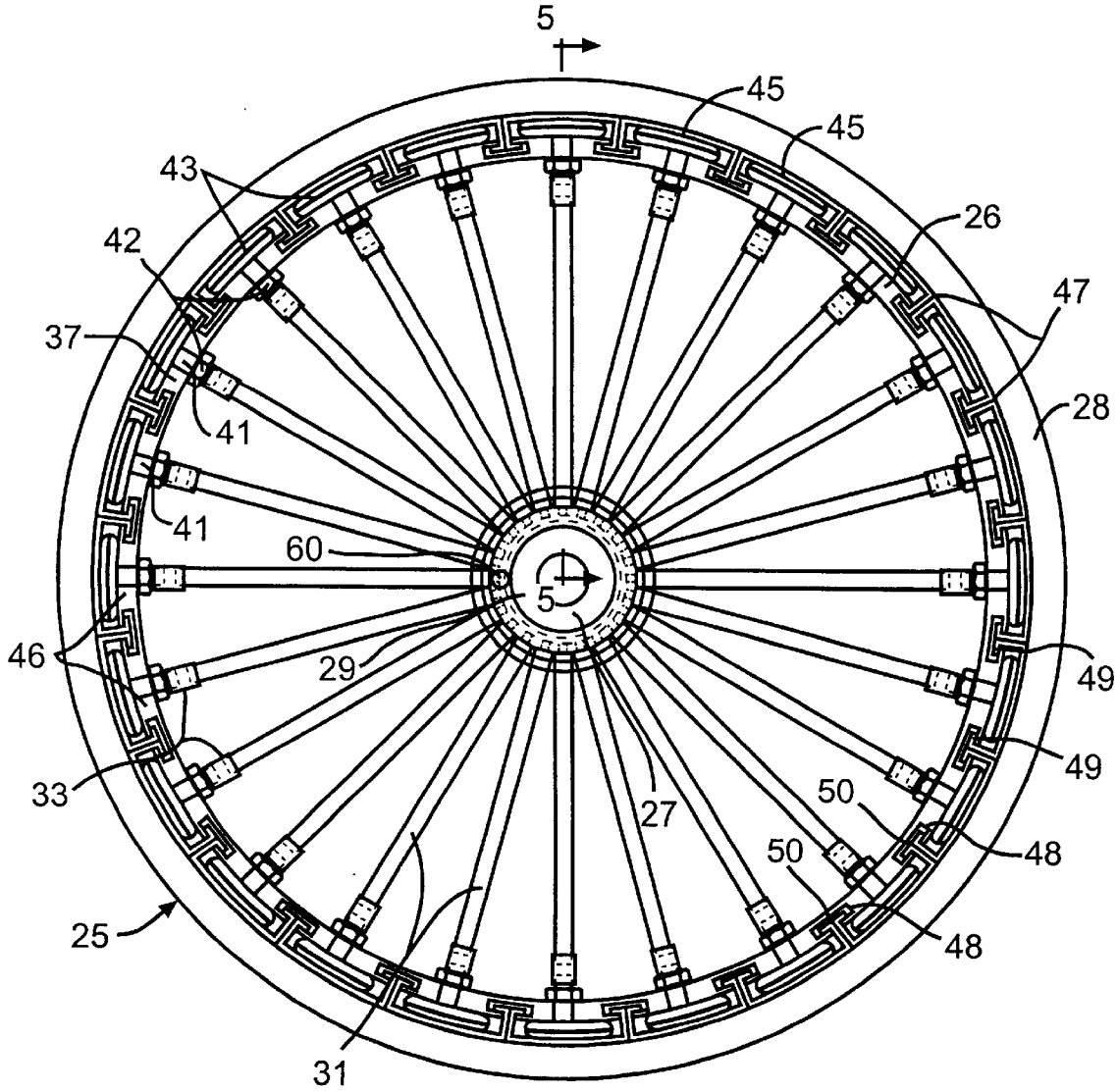
FIG. 3 is a rear elevation view of one embodiment of an inflatable/deflatable expandable wheel according to the present invention for use as a backup roll or blade roll on the chopper of the present invention.
Figure 4A:
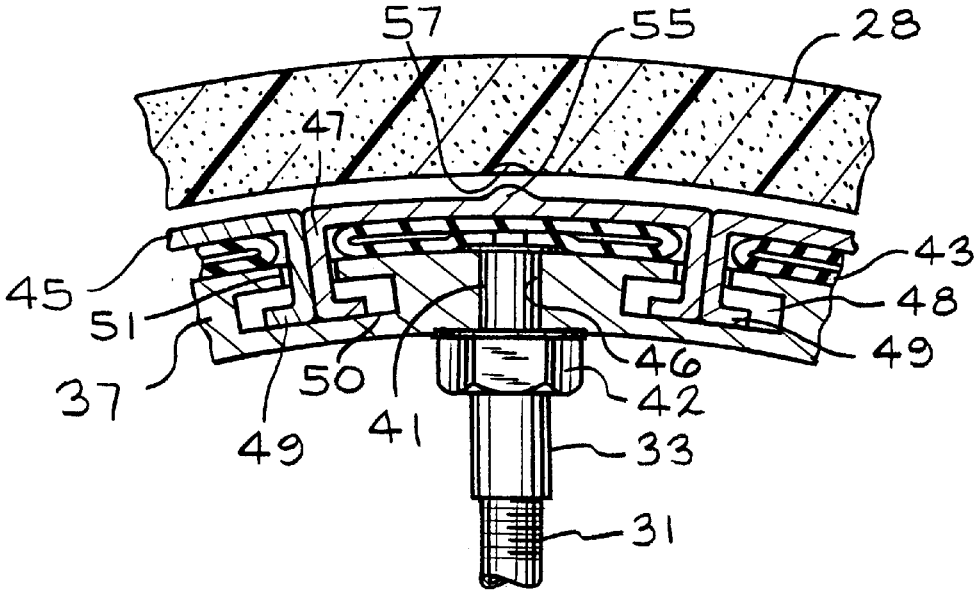
FIG. 4A is a partial rear cross sectional view of the outer peripheral portion of the wheel and working layer shown in FIG. 3 in a deflated or retracted mode.
Figure 4B:
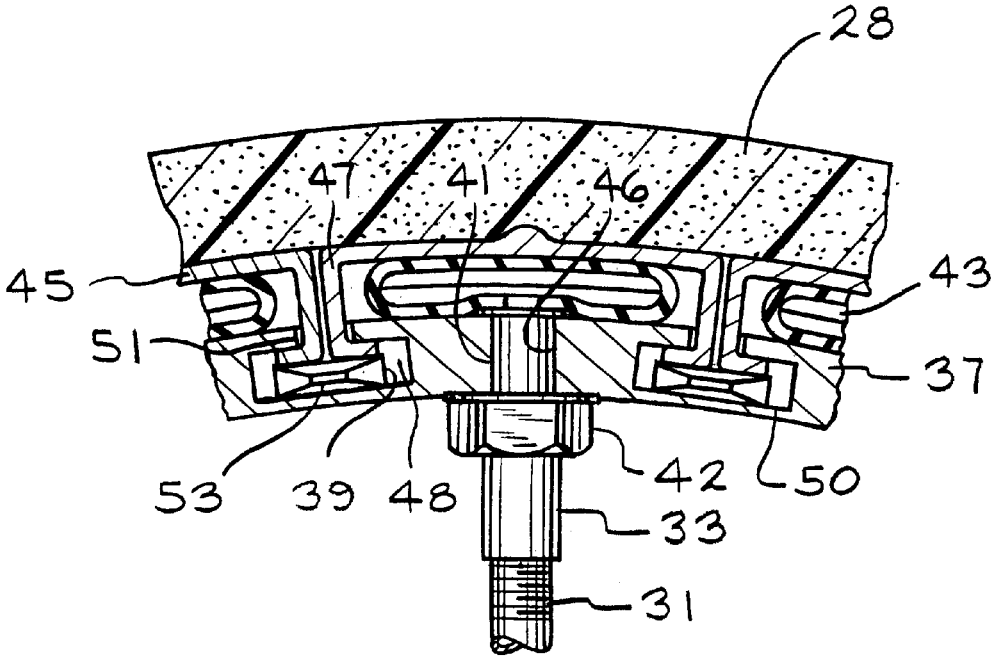
FIG. 4B is a partial rear cross sectional view of the outer peripheral portion of the wheel and working layer shown in FIG. 3 in an inflated or expanded mode.
Figure 5:
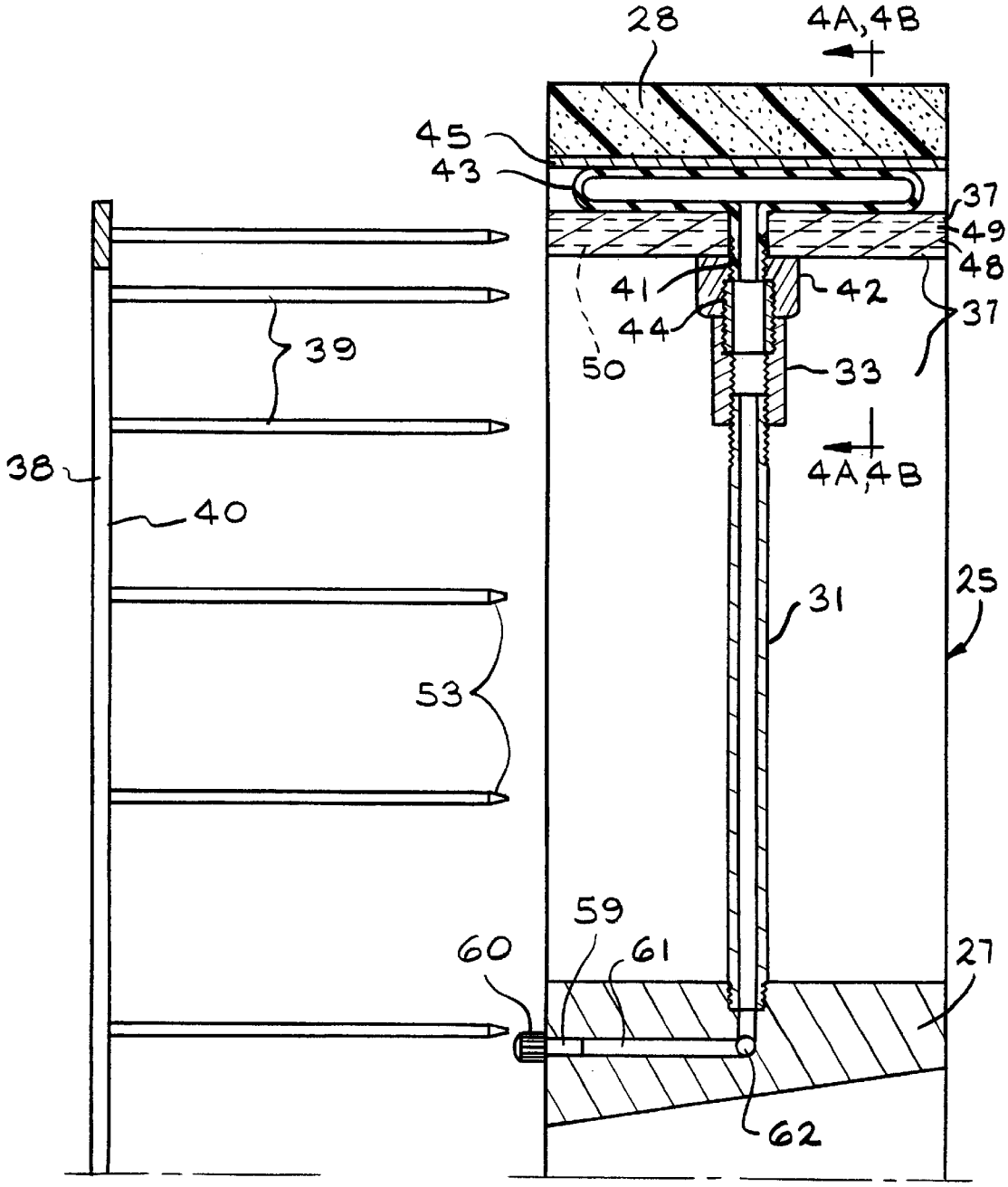
FIG. 5 is a partial cross section of the wheel shown in FIG. 4B and an uninstalled keeper ring.

FIG. 3 is a rear view of a preferred inflatable/deflatable backup and/or blade roll wheel 25 (I/D wheel) for the chopper of the present invention. FIGS. 4A, 4B and 5 show other views and details of the ID wheel 25. A working layer 28 is shown mounted on the wheel 25, but a blade holder could be mounted in the same manner. The ID wheel 25 comprises a center hub 27, with its interior surface 29 preferably tapered to fit onto a tapered spindle as will be described in detail later. Spaced apart and threaded into an outer portion of the hub 27 are hollow spokes 31. The other ends of the hollow spokes 31 are threaded into couplings 33 which in turn are threaded onto hollow stub fittings 44 that are threaded into one end of nuts 42 that tighten against the underneath side of an outer rim 37 to hold the rim 37 into place. Hollow stems 41 of inflatable pouches 43 pass through the center of holes 46 in the rim 37 and are threaded into inner peripheral portions of the nuts 42 which thread onto both the threaded ends of the hollow stems 41 and the exposed ends of stub fittings 44 (see FIG. 5). Nuts 42 lock the stems 41 and the stub fittings 44 into place and provide added support for the rim 37. To do this, nuts 42 have two internal threaded portions of different diameters. The larger diameter portion is for the stub fitting 44 and the smaller diameter portion is for the threaded end of the stem 41. The depth of the smaller diameter portion is sufficient to allow each nut 42 to be tightened against the inner peripheral surface of the rim 37.

Each inflatable pouch 43 lays on the outer peripheral surface of the rim 37 and extends across at least most of the width of the rim 37. Each inflatable pouch 43 is held in place with a movable flight bar 45.

Referring to FIGS. 4A and 4B, a plurality of the flight bars 45, each spaced apart slightly from the adjacent flight bars 45 to allow movement without binding, form the outer periphery of the ID wheel 25. Each flight bar 45 extends across at least most of the width of the rim 37 and has two turned down portions 47 and then two turned in end portions or lips 49. Each flight bar 45 forms a long C shaped structure, when turned on end, which surrounds three sides of the inflatable pouch 43.

The rim 37 has a plurality of spaced apart bottle shaped slots 48 in its interior and which communicate with the outer peripheral surface of the rim 37 via a narrow, "neck" portion 51 of each slot 48. As better shown in FIGS. 4A and 4B, each slot 48 contains one lip 49 of each of two adjacent flight bars 45, the lip 49 of each flight bar 45 residing in the wider portion of the slot 48. Each lip 49 is free to move a short distance radially inward and outward. The outward movement of each lip 49 is limited, stopped, by the top of the wider portion of the slot 48, as shown in FIG. 4B and the inward movement of each lip 49 is limited by the bottom 50 of the slot 48, as can be seen in FIG. 4A.

FIG. 5 is a partial cross section view of the ID wheel of FIG. 3 in an inflated mode showing an uninstalled keeper ring 38 containing a plurality of spaced apart keeper pins 39 located around an inside surface 40 of the keeper ring 38. The keeper pins 39, which are preferably rectangular in cross section in this embodiment, are spaced around the keeper rim to align with the wide portion of the slots 48 in the rim 37. Each keeper pin 39 has a tapered end 53 to ease the entry of the keeper pins into one end of the slots 48. FIG. 4B shows the keeper pins 39 in place with the inflatable pouches 43 inflated and the lips 49 against the top of the slots 48. In this inflated and working mode, the keeper pins 39 retain the flight bars 45 in a fixed position supporting the working layer 28 in snug to very tight contact. The very tight contact is produced by slightly stretching the elastomeric working layer 28 when the inflatable pouches 43 are inflated to bring the lips 49 of the flight bars 45 into contact with the top of the slots 48. The keeper pins 39 and the keeper ring 38 are then aligned and pushed into place until the surface 40 is against the front face of the rim 37, and can be held in the locking, operating position in any suitable manner. One way is by slightly deflating the inflatable pouches such that the lips 49 apply a retaining force on the keeper pins 39. Another is achieved by placing one or more fast acting retainers of known type (not shown) on the inside periphery of the rim 37 to engage and hold the keeper ring 38 in operating position.

Figure 8:
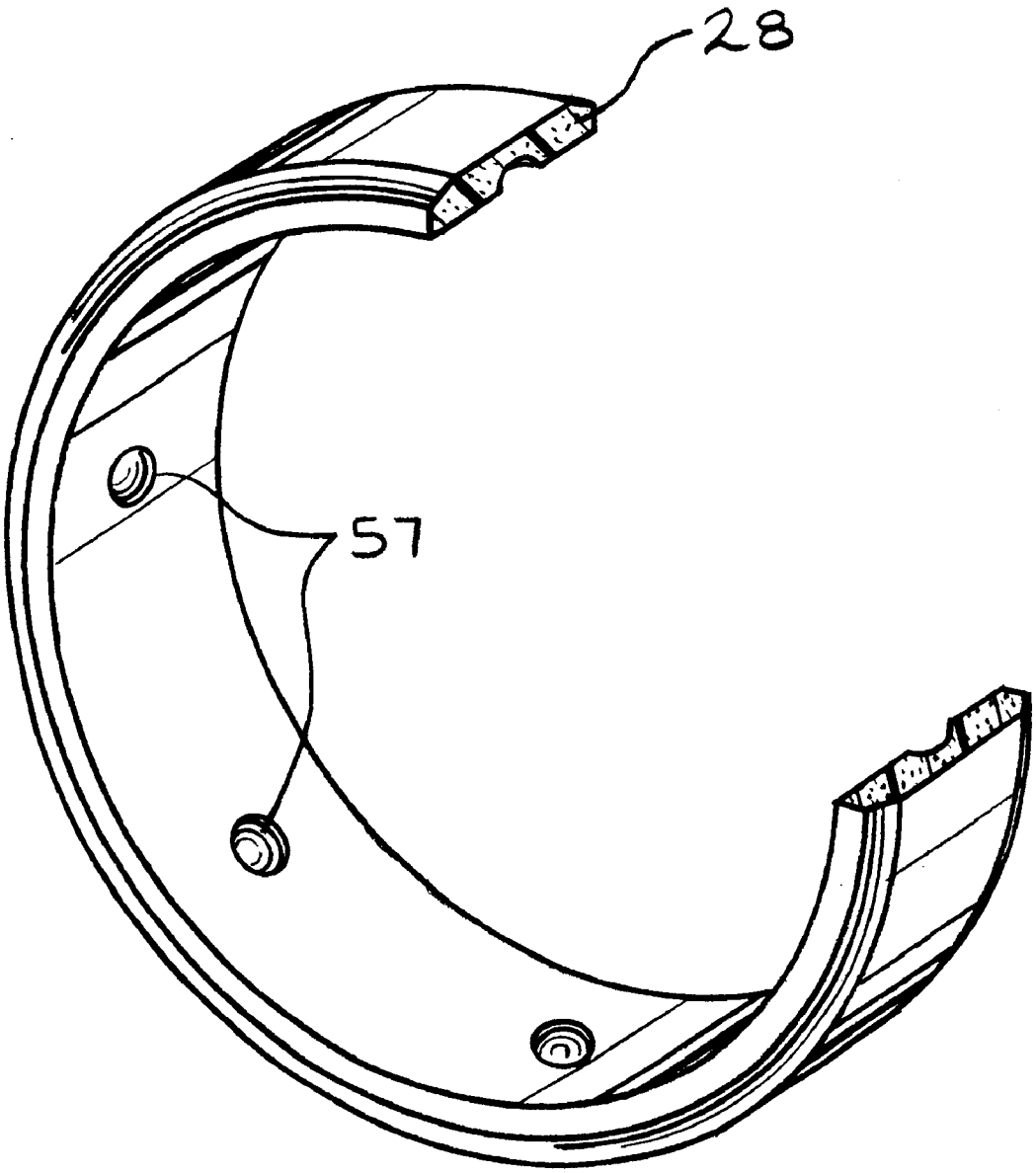
FIG. 8 is a perspective view of a novel working layer, partially cut away, for use on the novel backup rolls according to the present invention.

In the embodiment, shown in FIGS. 4A and 4B, and 8 at least some of the flight bars 45 have at least one projecting dimple 55 on the outer surface which will align with corresponding convex depressions 57 in the inner peripheral surface portion of the working layer 28 to prevent the working layer 28 from moving around on the rim 37 of the ID wheel 26 while the chopper 2 is operating and chopping strands, etc. Many other means may be used to secure the working layer 28 onto the flight bars 45 in a safe manner for operation.

Figure 10:
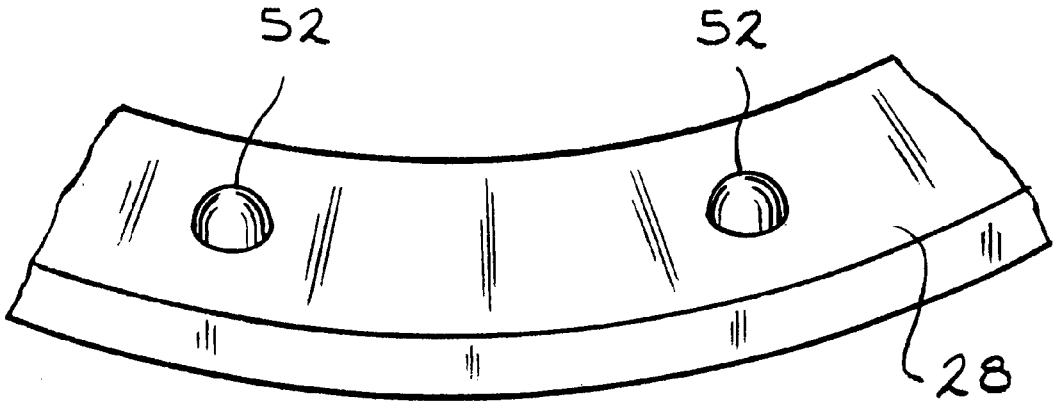
FIG. 10 is a partial perspective view showing the inner peripheral surface of another embodiment of a working layer or blade holder according to the present invention.
Figure 11:
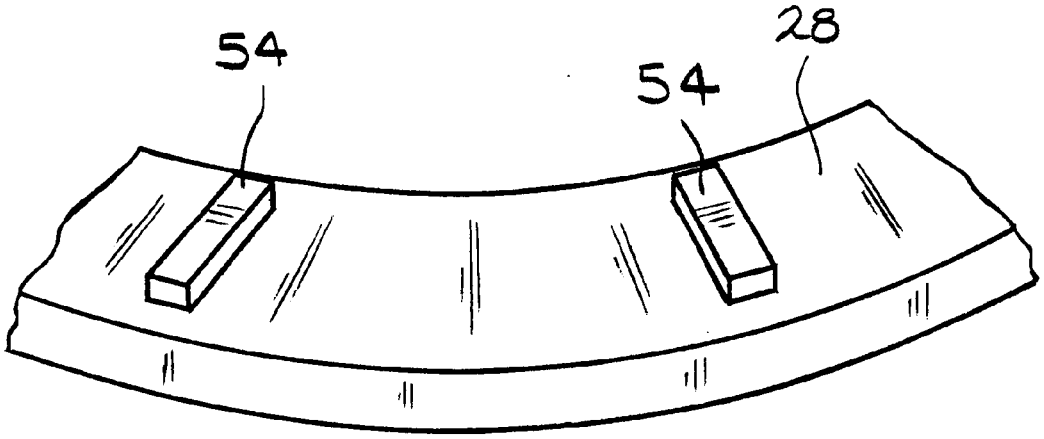
FIG. 11 is a partial perspective view showing the inner peripheral surface of still another embodiment of a working layer or blade holder according to the present invention.

Two of the many other optional embodiments are shown in FIGS. 10 and 11, partial perspective views of different configurations of working layers 28. In FIG. 10 the working layer 28 has projections spaced apart around the inner peripheral surface, such as dimple projections 52, to align with mating depressions in some or all of the flight bars 45. In FIG. 11, the working layer 28 has rectangular, bar-like projections 54 spaced apart around the inner peripheral surface to align with similar shaped depressions in some or all of the flight bars 45. The bar-like projections 45 could be oriented differently than parallel to the axis of the hub 27. Most any shape of projection and/or depression would be suitable for the surface of the flight bars 45 and the inner peripheral surface of the working layer 28 or the blade holder 63. The outer surface of the flight bars can also be knurled or grooved allowing the relatively soft elastomer to penetrate the grooves when the flight bars 45 are in an expanded mode to hold the working layer 28 securely in place.

Referring to FIGS. 4A, 4B and 5, the ID wheel 26 the air flow to and from the inflatable pouches 43 is through a valve stem 59, like a valve stem on an automobile wheel, through a channel 61 in the hub 27 that communicates with a manifold channel 62 that communicates with the hollow interior of each spoke 31. The hollow portion of the spoke 31 communicates with the hollow portions of the coupling 33, the stub fitting, nipple, 44 and the stem 41 of each inflatable pouch 43. A slide-on or threaded cap 60 is placed over the valve stem 59 to protect the valve from the wet, sticky environment which can exist in this area of the chopper 2.

Any suitable expandable and retractable mechanism or assembly for moving, retracting, the flight bars 45 from the operating or working position to the retracted position and back can be used so long as in the expanded condition it supports the surface portion of the roll in suitable manner for chopping. When using normal thicknesses of the working layer 28 or the blade holder it is not necessary that the flight bars 45 of the ID wheels or RD wheels contact each other, or almost do so, to form an essentially continuous outer periphery surface. Gaps of up to 0.010 to 0.030 inch between the flight bars 45 in the expanded mode are suitable without detracting from the chopping effectiveness or efficiency and gaps of up to 0.100 inch or more are suitable in the retracted mode.

The ID wheel of FIGS. 3–5 is operated in the following manner. To install a new working layer 28 onto the ID wheel 25, the cap 60 is removed and the valve 59 is opened to deflate the inflatable pouches 43 allowing the flight bars to retract radially. After removing a worn working layer 28, a new working layer, or elastomer tire, 28 is slid over the rim 37 and flight bars 45 until it is in the proper location, preferably to align depressions 57 in the interior peripheral surface portion of the working layer 28 with raised portions like dimples 55 on the flight bars. A fluid, such as compressed air, is then passed through the valve stem 59 and fed to each of the inflatable pouches until they have moved the lips 49 of the flight bars 45 against the rim 37 at the top of the slots 48, preferably stretching the working layer 28 somewhat. Holding onto the keeper ring 38, the tapered ends 53 of the keeper pins 39 are slid into the slots 48 from the outboard side of the rim 37 until the inside surface 40 of the keeper ring 39 is flush with the rim 37. Preferably, enough air, or other fluid, is then released out through the valve stem 59 to partially deflate the inflatable pouches 43 to cause the lips 49 of the flight bars 45 to press against the keeper pins 39 to secure them into place and to provide a solid, unmoving support for the inner peripheral surface of the working layer 28. The cap 60, if used, is placed over the end of the valve stem 59 and the ID wheel on the chopper 2 is now ready for operation.

When it is desired to replace the working layer 28, the chopper 2 is stopped, the cap 60 is removed and, if using the above described technique to hold the keeper pins 39 in place, fluid under pressure is fed into the valve stem 59 to inflate the inflatable pouches 43 to move the lips 49 of the flight bars 45 off of the keeper pins 39. The keeper ring 38 and the keeper pins 39 are removed and fluid is allowed to escape through the valve stem 59 to deflate the inflatable pouches 43, retracting the flight bars 45 sufficiently to allow the removal of the worn working layer 28. Using an ID wheel 25 of the present invention to change the working layer 28 instead of the prior art backup roll 8 (FIG. 1) saves more than 1–2 minutes of downtime on every chopper rebuild and eliminates the lifting, carrying, storing, transporting and handling of the heavy backup rolls 8, and reduces capital investment in the heavy hubs of the backup rolls 8 and other support equipment. As will be seen below, the ID wheel 25 concept or design can also be used as part of a blade roll to achieve further advantages.

Figure 5A:
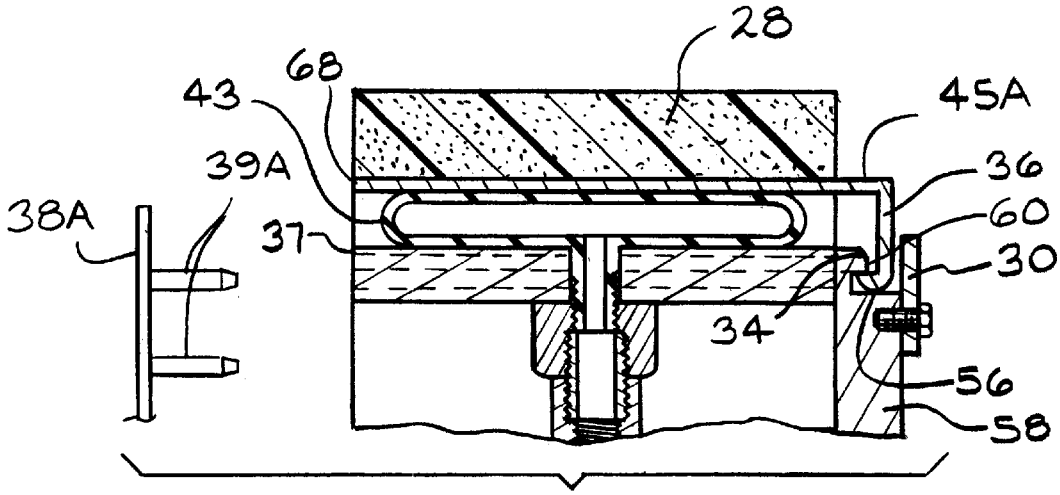
FIG. 5A is a partial cross sectional view of another embodiment of the present invention that is a modification of the embodiment shown in FIGS. 3, 4A, 4B and 5.

FIG. 5A is a partial cross section view of an I/D wheel showing the outer periphery that is a modification of the I/D wheel shown in FIGS. 3–5. In this embodiment everything is the same except the shape of the flight bars 45A, the addition of a back plate 58 and a keeper rim 30 and the length of keeper pins 39A. The flight bars 45A are wider and the back portion extends past the inboard side of the rim 37, turns down to form a vertical leg 36 and then turns in for a short distance to form a foot 56. The foot 56 fits loosely under an ear 34 on the outer periphery of the back plate 58. The ear 34 is radiased on its upper end 60 that allows the outboard end 68 of the flight bar 45A to move toward the rim 37 when the pouch 43 is deflated, i.e. allows the flight bars 45A to tilt toward the rim 37 on the outboard side of the rolls 6 and 8. This tilting of the flight bars 45A allows a worn working layer 28 to be removed and a new working layer 28 to be installed. The keeper rim 30, held in place with a few circumferentially spaced bolts 32 threaded into the back plate 58, keeps the flight bars 45A in a proper position. After a new working layer 28 is in place, the inflatable pouch 43 is inflated to move the flight bars 45A back into operating position to slightly stretch the circumference of the working layer 28 and slightly beyond so that the keeper ring 38A with short pins 39A can be put into place in the manner described above for keeper ring 38. Thereafter, the pouch 43 is deflated allowing the outboard ends of the feet 49 (See FIGS. 4A and 4B) of the flight bars 45A to contact the keeper pins 39A with sufficient force, due to the stretched elastomeric working layer 28, to hold the keeper ring 38A and keeper pins 39A in place during operation. This arrangement provides a positive, rigid support for the working layer 28 while in operation. One advantage of this embodiment is that the flight bars 45A are more easily held in proper position at all times.

Figure 12A:
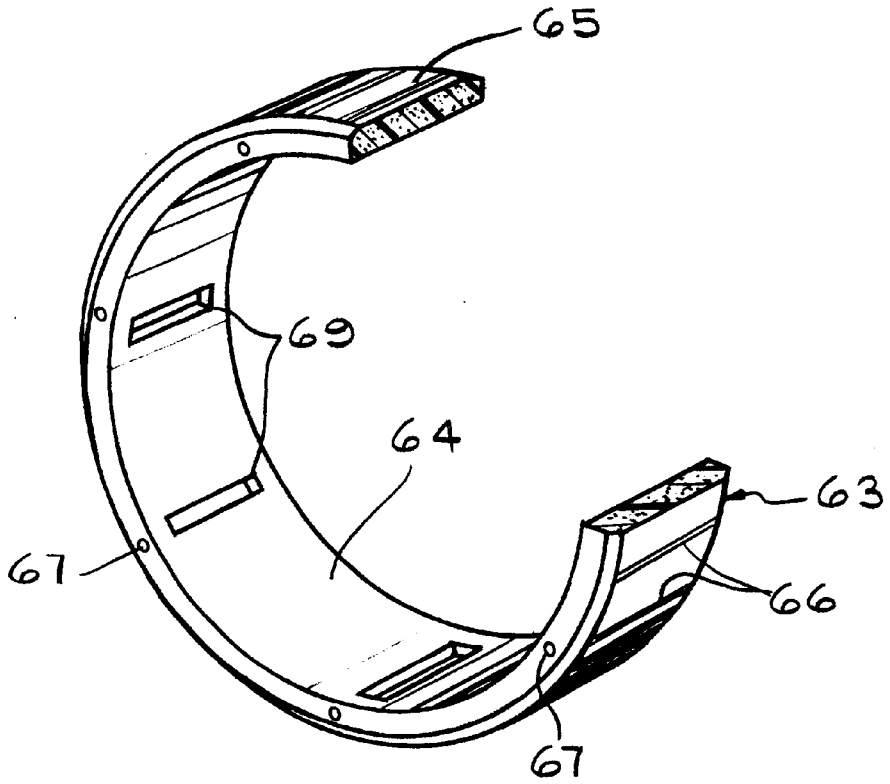
FIG. 12A is a partial perspective view of one embodiment of a blade holder according to the present invention for use on the expandable/retractable rolls of the present invention.
Figure 12B:
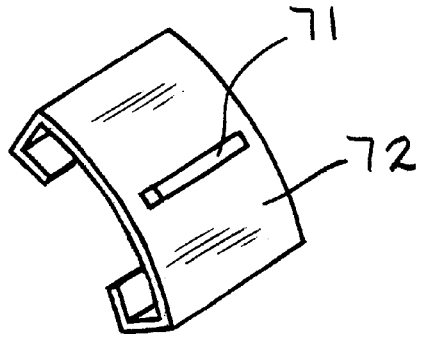
FIG. 12B is a perspective view of one embodiment of a floating flight bar for use in the rolls of the present invention such as the blade holder shown in FIG. 12A.

FIG. 12A shows a preferred embodiment of a blade holder 63 according to the present invention for holding conventional chopping blades 7 and for use on another ID wheel that is just like or similar to the ID wheel 25. Normally the ID wheel for holding the blade holder 63 will be smaller in diameter than the ID wheel 25 for the working layer 28. The blade holder 63 preferably comprises a rim 64, preferably of a thermoplastic or elastomeric material or metal, a blade support member 65, preferably of a thermoplastic or elastomeric material, having spaced apart slots 66 for receiving the blades 7 (see FIG. 1). The rim 64 contains several threaded holes 67 spaced apart around the rim, parallel to the width of the inner periphery, on both the outboard side and the inboard side. These threaded holes 67 are for bolting on outboard and inboard blade retainer members (not shown here, but shown in detail in U.S. Pat. No. 4,083,279). Preferably, the inside peripheral surface portion of the rim 64 has spaced apart depressions 69, preferably elongated rectangular shaped as shown, for receiving bar shaped projections 71 on the outer surface of some or all of the flight bars 72 (see FIG. 12B) to secure the blade holder 63 and prevent it from moving with respect to the ID wheel or RD wheel. It is not necessary to have a separate rim 64 and blade support 65, these two parts can be integrated into a single part, preferably made of a thermoplastic or elastomeric material like polyurethane.

Figure 6C:
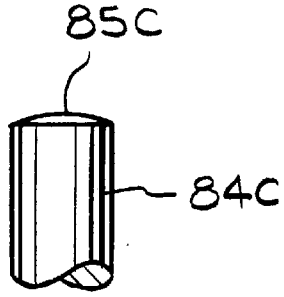
FIG. 6C is a partial elevational view of an optional end portion of a pushrod used in the embodiment shown in FIG. 6A.
Figure 6D:
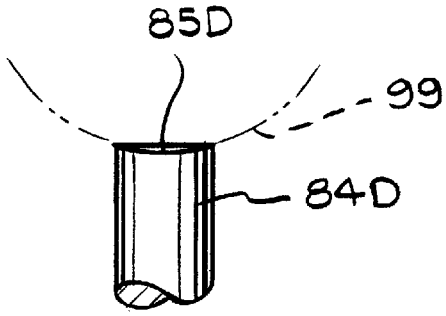
FIG. 6D is a partial elevational view of a further optional end portion of a pushrod used in the embodiment shown in FIG. 6A.
Figure 6E:
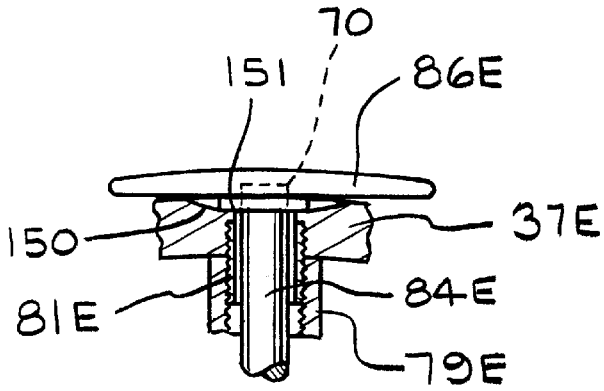
FIG. 6E is a partial elevational view showing a modification of the embodiment of FIG. 6A, the modification being the manner of holding a push rod in a non-rotational manner.
Figure 6A:
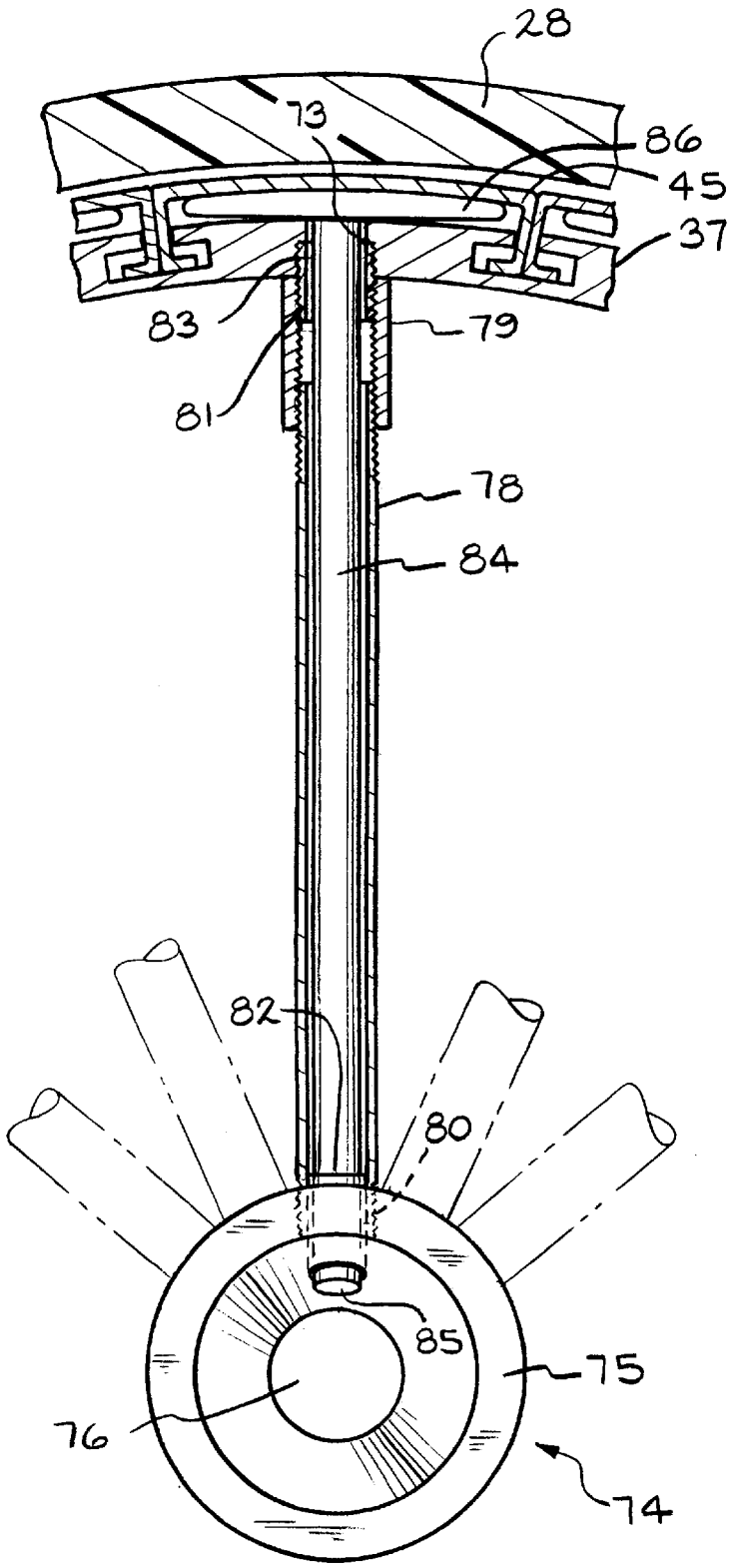
FIG. 6A is a partial rear cross sectional view of one embodiment of a mechanical expandable/retractable wheel according to the present invention for use as a backup roll or blade roll.
Figure 6B:
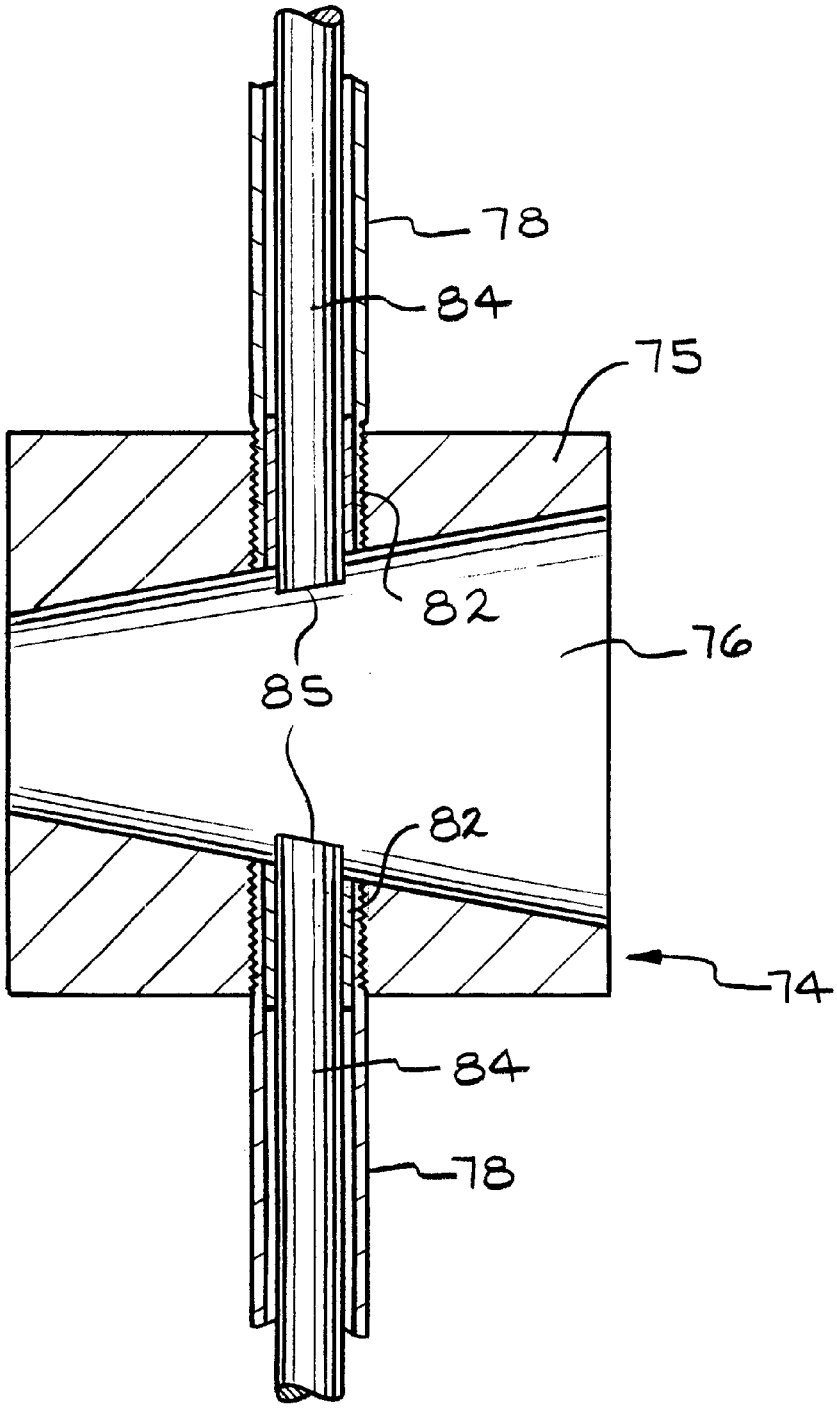
FIG. 6B is a partial cross section of the hub portion of the wheel shown in FIG. 6A.

FIG. 6A is a partial rear cross sectional view, and FIG. 6B is a cross section of the hub and center portion, of a mechanical activated ER wheel 74 having a hub 75 respectively of the ER wheel 74. This ER wheel 74 is similar to the ID wheel of FIGS. 3–5 except that mechanical forces are used to expand and retract the outer diameter of the wheel instead of fluid pressure. This ER wheel 74 is comprised of a hub 75 having a tapered passageway 76 around the centerline of the hub to match a tapered spindle on the chopper 2. A plurality of hollow spokes 78 with one end threaded into the hub 75 and the other end threaded onto a coupling 79. The end of each of the hollow spokes 78 threaded into the hub 75 contains a bushing 80. A rim 37 and a plurality of flight bars 45 are exactly like the rim 37 and flight bars 45 previously described in FIGS. 3–5. The other end of each hollow spoke 78 is connected to the rim 37 by way of a nipple 81 threaded into holes 73 in the rim 37 and extending inwardly from the inner peripheral surface of the rim 37. The coupling 79 is threaded onto the end of the hollow spoke 78 and is also threaded onto the exposed portion of the nipple 81 until tight against the rim 37. Each nipple 81 has a hollow bushing 83 in its interior.

Each hollow spoke 78 contains a push rod 84, 84C (FIG. 6C) or 84D (FIG. 6D) having a tapered end 85 or a domed end 85C, or a concave tapered end 85D (FIG. 6D) on the end portion that passes through the hole in the hub 75 and into the passageway 76. The angle of the taper on the end 85 of the pushrod 84 is at least as great as the angle of the taper of the passageway 76 in the hub 75 and the angle of the tapered portion 99 of the spindle 117, 118 (see FIG. 7B). The other end portion of each push rod 84 passes through the bushing 83 in the rim 37 and is attached by any suitable means, preferably rigidly, to a paddle 86 residing in the slot 48 and beneath the flight bar 45. The paddle 86 has the function of pushing the flight bar 45 outward against the working layer 28. The paddle 86 can be as long and wide as, and preferably is almost as long and wide as, the flight bar 45, but can be significantly less in either or both dimensions. The top surface of the paddle 86 is preferably radiased to match the mating surface of the flight bar 45 so the paddle 86 and the push rod 84 attached tend not to rotate. The push rod 84C shown in FIG. 6C makes a point contact with the tapered portion 99 of spindle 117, 118 and the push rod 84D shown in FIG. 6D makes an area contact with the tapered portion 99.

To operate the ER wheel 74, one merely loosens the nut 19 or other device holding the hub 75 onto the tapered spindle 17 of the chopper 2 and pulls the hub 74 away from the face plate 4 a small distance. This allows the tapered ends 85 of the push rods 84 to extend into the tapered passageway 76 and the paddles 86 and the flight bars 45 to move radially toward the hub 75. This movement allows the worn working layer 28 (or worn blade holder 63) to be removed and replaced with a new or repaired unit. After positioning the new working layer 28 (or repaired blade holder 63) properly on the ER wheel 74, the hub 75 is tightened onto the shaft 17 (or 18) which pushes the tapered ends 85 of the push rods 84 outward until flush with the surface of the passageway 76 and pushing the paddles 86 radially outward and extending the flight bars 45 against the new working layer 28 (or repaired blade holder 63) thus securing the new working layer 28 (or repaired blade holder 63) onto the ER wheel 74. A keeper rim and pins are not required for the ER wheel 74 because the flight bars 45 are held in place mechanically by paddles 86 and pushrods 84 during operation. The ER wheel 74 is now ready for operation.

FIG. 6E shows a preferred way of keeping the paddle 86 and push rod 84 in the embodiment shown in FIGS. 6A and 6B from rotating. In this modification, paddle 86E is rigidly attached to the outer end of push rod 84E by press fitting the outer end of the push rod 84E into a hole 70 in a bottom portion of the paddle 86E. An enlarged portion 99, having two opposite parallel sides, of the push rod 84E immediately below the bottom surface of the paddle 86E resides in a milled out portion 150 of the top surface of the rim 37E. The milled out portion 150 also has two parallel sides that mate with the enlarged portion 99 thus preventing the enlarged portion 99 to rotate thus also preventing the push rod 84E and the paddle 86E from rotating during operation or during retracting and expanding of the wheel to change the working layer 28 or 63.

Any known type of mechanical expandable/retractable wheel or roll can be used in place of the ER wheel 74 described above. For example, those disclosed in U.S. Pat. Nos. 4,110,149 and 3,000,585, the disclosures of which are incorporated herein by reference, for use on winders can also be used in the present invention.

Figure 7A:
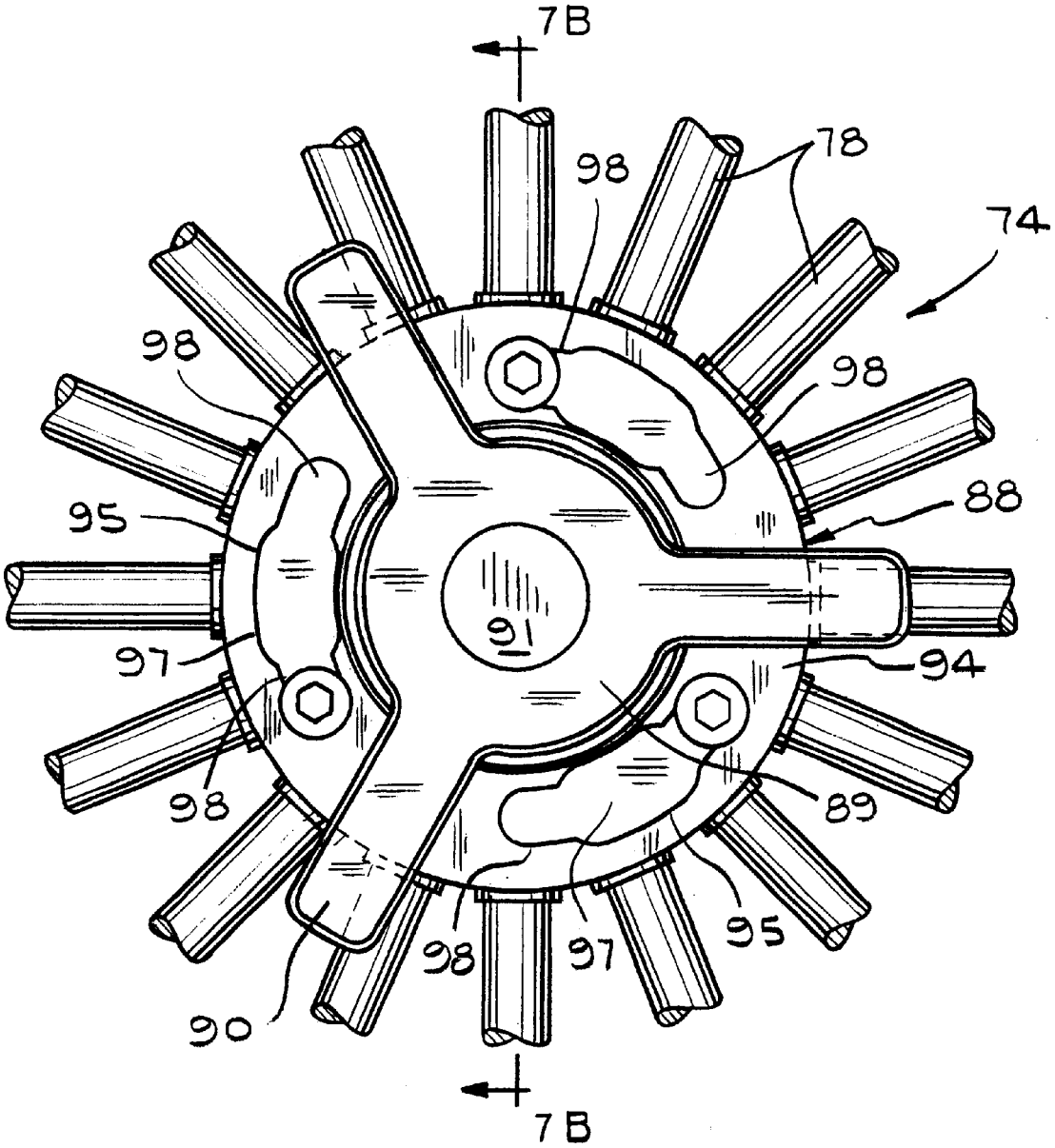
FIG. 7A is a partial elevational front view of an expandable/retractable wheel like that shown in FIGS. 6A and 6B and showing a novel fast acting wheel retainer for use with these types of wheels.
Figure 7B:
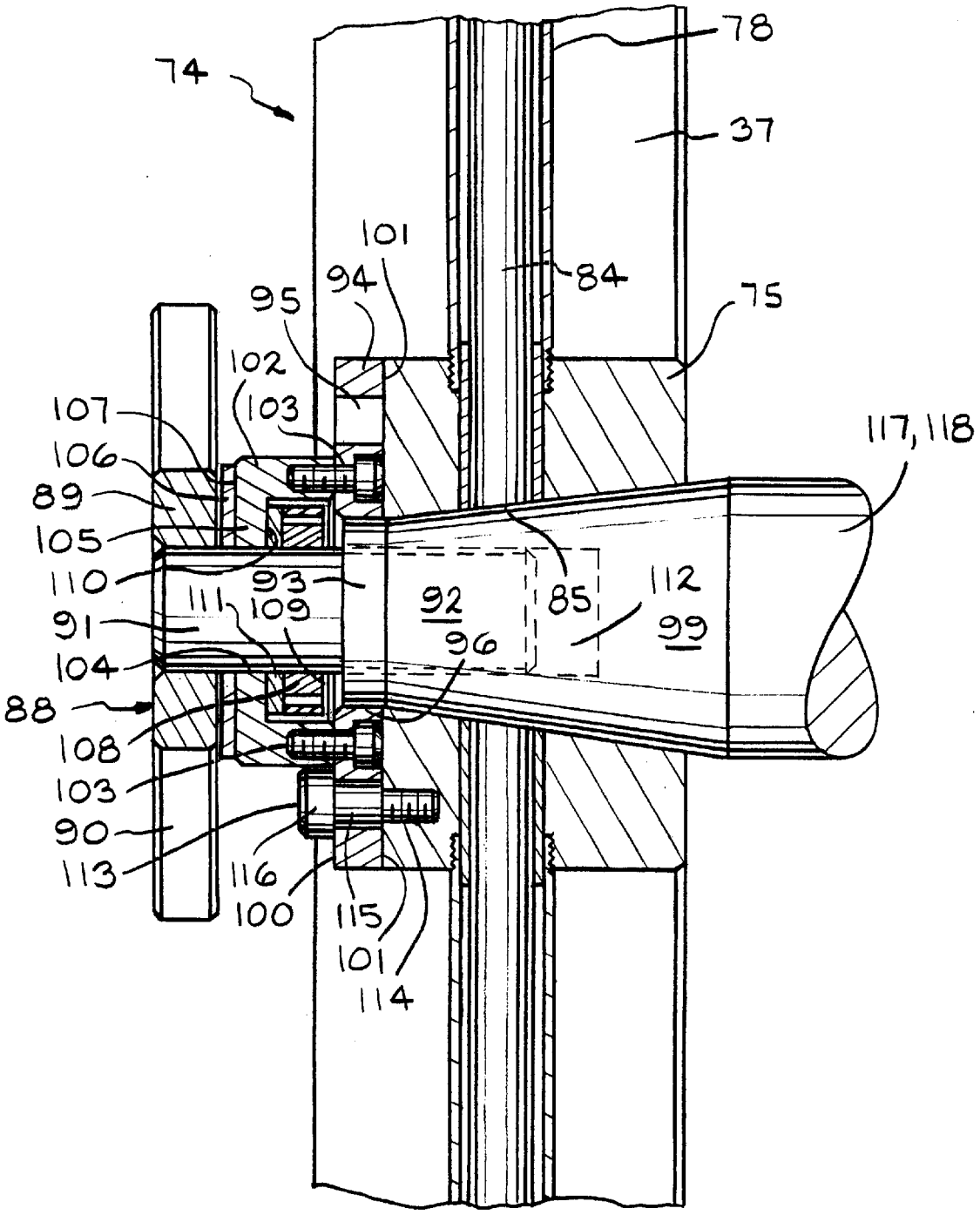
FIG. 7B is a partial cross section of the wheel and a cross section of the wheel retainer shown in FIG. 7A.
Figure 7C:
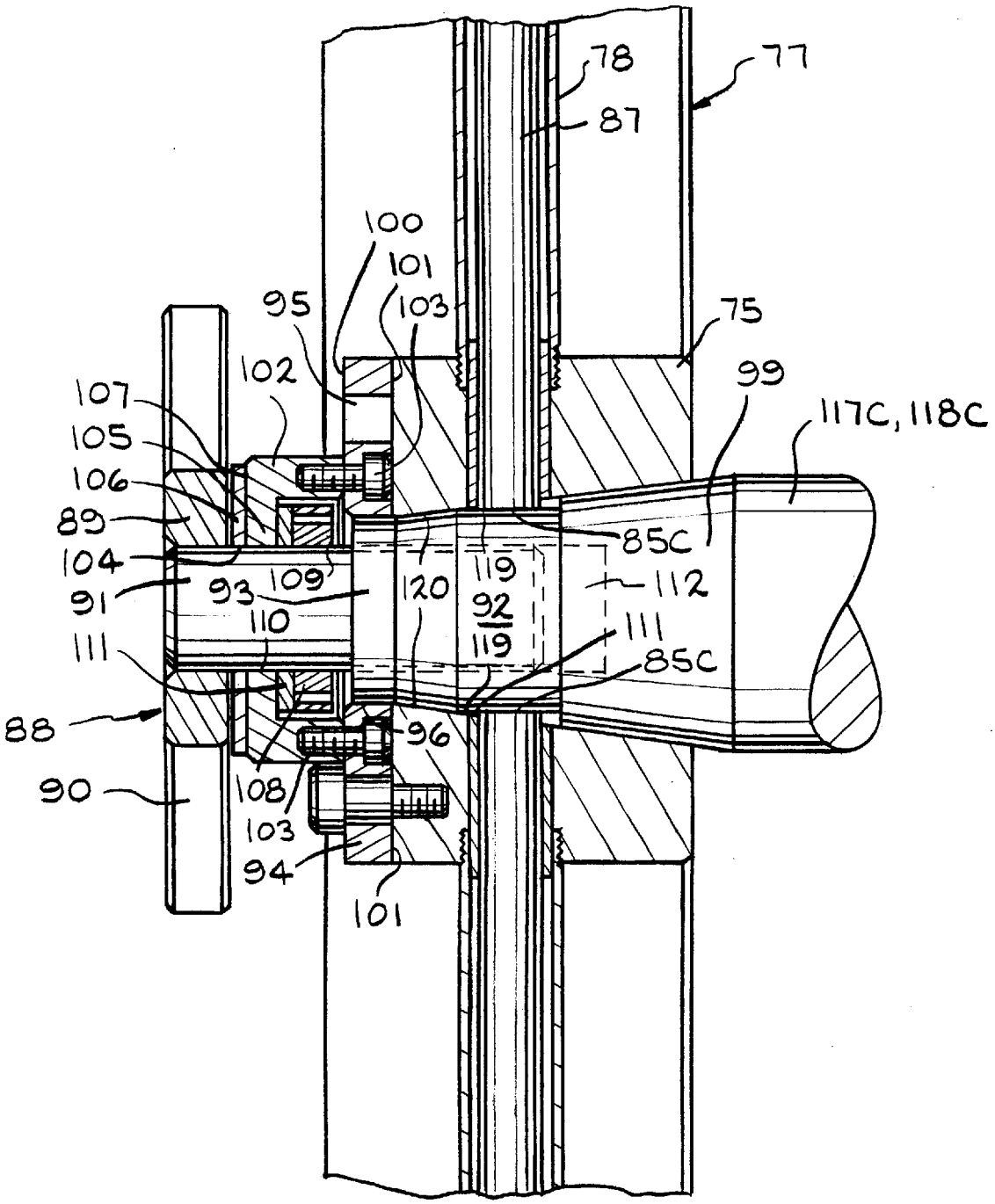
FIG. 7C is a partial cross section of another wheel and spindle embodiment with a cross section of the roll retainer shown in FIG. 7A.

FIGS. 7A, 7B and 7C show a preferred novel roll retainer device 88 for more quickly and easily loosening and tightening the ER wheel 74 onto the tapered shafts 117 and 118 of the chopper 2. This novel roll retainer device is disclosed in U.S. patent application Ser. No. 09/777,449 filed Feb. 6, 2001. FIG. 7A is a partial front elevation view of the ER wheel 74 showing the center portion of the ER wheel 74 fitted with the roll retainer 88. FIG. 7B is a partial cut away side view of the ER wheel 74, spindle 117, 118 and knock on-knock off device 88. FIG. 7C is a partial cut away side view of the most preferred spindle 117C, 118C configuration and ER wheel 77 in use with the roll retainer 88.

The quick acting knock-on/knock-off roll retainer 88 is comprised of a spinner 89, preferably having at least one handle 90 and most preferably two or three handles 90 which can be integral with the spinner 89. The spinner 89 is integral with or rigidly attached at or near one end of a stub shaft 91 which is threaded on an end portion 92, preferably on the outside of the end portion 92 of the stub shaft 91. However, in an alternative embodiment the stub shaft 91 could be a pipe and could be threaded on the inside of the pipe. In the latter embodiment, the stub shaft would fit over a threaded end of a spindle.

The roll retainer 88 also comprises a locking plate 94 having at least one, and preferably three, slots 95 therein that extend at least partially and preferably completely through the thickness of the locking plate 94. The locking plate 94 also has a circular hole 96 through its center having a diameter sufficient to slip loosely around the stub shaft 91 and preferably also easily around an end portion 93 of the spindle 118, 117 for either the backup roll wheel or the blade roll wheel. Since the roll retainer 88 is usable on both the backup roll spindle 118 and the blade roll spindle 117, the term ER wheel 74 and spindle 117, 118 will be used hereafter to mean either roll or spindle.

A centerline of each slot 95 is preferably an arc, being a radius of the axis of the stub shaft 91. Each slot 95 is also spaced from other slot(s) 95 and from an outer periphery of the hole 96 and has a wide portion 97 and at least one narrower end portion 98. Preferably, each slot 95 has a narrower end portion 98 on each end of the wide portion 97, as shown in FIG. 7A.

Preferably the locking plate 94 is circular with the spinner 89 rigidly attached to and centered on the stub shaft 91, the latter protruding through the hole 96 in the locking plate 94 such that the spinner 89 is spaced from an outboard face 100 of the locking plate 94 and the end portion 92 of the stub shaft 91 being spaced from an inboard face 101 of the locking plate 94. The outboard face 100 of the locking plate 94 should be parallel to the inboard face 101 of the locking plate 94, at least in an area adjacent to the narrow end portion(s) 98 of the slots 95.

The locking plate 94 is bolted to a locking cup 102 that surrounds the stub shaft 91 between the spinner 89 and the locking plate 94, preferably with a plurality of socket head cap screws 103, the heads of which are recessed in the inboard face 101 of the locking plate 94. The locking cup 102 has a circular hole 104 having a diameter slightly larger than the diameter of the stub shaft 91 and completely through its bottom 105 so that the locking cup 102 can rotate around the stub shaft 91 and vice versa. The locking cup 102 is oriented on the stub shaft 91 such that its bottom 105 is close to the spinner 89 and its top butts against the outboard face 100 of the locking plate 94.

Optionally, but preferably, a thrust washer or pre-lubricated washer 106 surrounds the stub shaft 91 in a loose and rotatable manner between the spinner 89 and an exterior bottom surface 107 of the locking cup 102 to allow the spinner 89 and the stub shaft 91 to more easily rotate, while under stress and while the exterior bottom surface 107 of the locking cup 102 remains stationary. A suitable washer for this purpose is an oil impregnated bronze thrust type washer. Other thrust washers can be used so long as they don't deform excessively under the load to cause binding to the bottom exterior surface 107 of the locking cup 102. Any type of thrust washer can be used. Lubrication of the washer 46 helps to prevent fiber sizing from drying and sticking to the washer surfaces.

A lock collar 108 surrounds the stub shaft 91 and is rigidly attached such as by being welded to the stub shaft 91 as with welds 109. The lock collar 108 can be rigidly attached to the stub shaft 91 in any suitable manner, such as welding, or could even be an integral part of the stub shaft 91, but in this case the spinner 89 would not be integral with the stub shaft 91. The lock collar 108 is attached to the stub shaft 91 such that it is contained in and surrounded on its periphery by the locking cup 102 with a face of the lock collar 108 closest to, but spaced from, an interior bottom surface 110 of the locking cup 102 and an opposite face closest to the locking plate 94. Optionally, but preferably, a lubricated thrust washer 111 surrounds the stub shaft 91 and resides in the space between the interior bottom surface 110 of the lock cup 102 and the face of the lock collar 108 closest to the interior bottom surface 110 of the locking cup 102. The thrust washer 111 is preferably the same type washer as the thrust washer 106. The purpose of the thrust washers 106 and 111 will be described later in the description of the knock on/knock off roll retainer 88.

The tapered portion 99 of the spindles 117,118 contacts the tapered portion 76 of the hub 75, a preferred optional feature since the spindle could be straight with a back stop, but the taper insures a tight fit of the hub 75 onto the spindle 117, 118. This tight fit is what has made it necessary to strike the backside of the prior art backup and blade rolls, or to pry the backup and blade rolls off their spindles. This is not necessary when the knock on/knock off roll retainer 88 is used with the expandable/retractable rolls of the present invention. The spindle 117, 118 need not be tapered on the portion that engages the hub 75, but can be of uniform diameter and can also have ridges or grooves to engage grooves or ridges in the hub 75 to insure against slippage.

In any case, prior art rolls 6,8 have been difficult to loosen from the spindle when was desired to remove the rolls 6,8 after they have been in operation chopping for at least a few hours.

In the embodiment shown in FIGS. 7A and 7B, the spindle 117, 118, including an outboard tapered end portion 99, has a threaded opening 112 centered around its axis on its outboard end to accept the threaded portion 92 of the stub shaft 91 in a threaded relationship. Preferably, the outer periphery of the outboard end portion 93 of the spindle 117, 118 is surrounded by the locking plate 94 as it resides in the opening of the locking plate 94 and/or at least a portion of the locking plate 94 when any one of the expandable/retractable rolls of the present invention is in place on the spindle 117, 118.

Threaded into the outboard face of the hub 75 are at least one and preferably two, three or more spaced apart shoulder bolts 113 having a threaded portion 114 and an unthreaded portion 115 having a diameter of slightly less than the width of the end portion 98 of the slots 95 in the locking plate 94 of the roll retainer 88. Each shoulder bolt 113 also has a head 116 having a diameter larger than the width of the end portion 98 of the slots 95, but smaller than the width of the wide portion 97 of the slots 95. The length of the unthreaded portion 115 of the shoulder bolts 113 should be slightly greater than the thickness of the locking plate 94. To save time in operating the backup roll wheel or blade roll wheel 74 shown in FIGS. 6A and 6B, it is preferred that all such wheels be equipped with the shoulder bolts 113 secured tightly into the hub 75, but of course, neither of these preferences or modifications are necessary to practice the present invention.

Also, preferably, but not necessarily, all of the secured shoulder bolts 113 are spaced apart, preferably equally spaced apart, around a single radius of the axis of the opening 96 in the locking plate 94, but obviously different arrangements will also work so long as the slots 95 in the locking plate 94 align with the shoulder bolts 113 when the stub shaft 91 is threaded into the opening 112 of the spindle 117, 118. All parts of the roll retainer 88, except for the thrust washers 106 and 111, are preferably made from a strong material such as a stainless steel that will not corrode in the hot, wet environment. Many other materials can also be used such as other metals, alloys and fiber reinforced plastics.

To use the fast acting roll retainer 88 as part of the present invention, an expandable/retractable wheel such as the wheel 74, preferably having three shoulder bolts 113 secured in the hub 75 as shown in FIGS. 7A, 7B and 7C, is placed on the spindle 117, 118, preferably until the ends 85 of the push rods 84 (FIG. 6B) contact, or nearly contact, the tapered portion of the spindle 117, 118. A desired working layer 28 or blade holder 64 should be in place on the wheel 74 at this time.

The threaded end portion 92 of the stub shaft 91 of the roll retainer 88 is then threaded into the threaded opening 112 of the spindle 117, 118 at least several turns by turning or spinning the spinner 89 and handles 90. Next, the locking plate 94 is rotated with one hand, preferably while holding the handle(s) 90 with the other hand to prevent the stub shaft 91 from rotating, to align the wide portion 97 of the slots 95 with the heads 116 of the shoulder bolts 113, and then the stub shaft 91 is rotated into the opening 112 of the spindle 117, 118 until at least hand tight using the handles 90. Then, the spinner 89 is backed off about 5–180 degrees and the locking plate 94 is rotated to seat the end portion 98 of the slots 95 against the unthreaded portion 115 of the shoulder bolts 113. Last, the spinner 89 is rotated to tighten the inboard face 101 of the locking plate 94 against the outboard face of the hub 75 and finally, tightened by striking one of the handles 90 with a dead blow, such as by striking it with a lead-headed hammer or a hammer containing heavy pellets in the head portion. As the hub 75 moves against the tapered portion of the spindle 117, 118 in these latter steps, the ends 85 of the push rods 84 will engage increasing diameters of the taper of the spindle 117, 118 causing the push rods 84, the paddles 86 and the flight bars 45 to be pushed outward radially against the working layer 28 or blade holder 63 securing the latter to the wheel 74. In the final tightening step the lubricated washer 106 enhances the relative movement of an inboard face of the spinner 89 to move while the exterior bottom surface of the locking cup 102 remains fixed, i.e. does not rotate. The wheel 74 is now in place and ready to operate.

When it is time to replace the working layer 28 or the blade holder 63 on the wheel 74 on a shut down chopper 2, one of the handles 90 is struck one or more dead blows to start backing the stub shaft 91 out of the hole 112 in the spindle 117, 118. As that happens the outboard face of the lock collar 108 pushes against the second lubricated thrust washer 111 which pushes against the interior bottom surface 110 of the locking cup 102. Note that the lock collar 108 is fixed to, or integral with, the stub shaft 91. The thrust washer 111 enhances the relative movement of the outboard face of the rotating lock collar 108 and the non-rotating interior bottom surface 110 of the locking cup 102 under stress. As the lock cup 102 is pushed in an outboard direction by the action of backing the stub shaft 91 out of the hole 112, the wheel 74 is pulled loose from the tapered portion of the spindle 117, 118 by the outboard face 100 of the lock plate 94 pushing against the underside of the heads 116 of the shoulder bolts 113. Once the hub 75 has been broken loose from the taper on the spindle 117, 118, the spinner 89 is rotated in the same direction sufficiently to allow the push rods 84 to move radially towards the spindle 117, 118, thus loosening the working layer 28 or blade holder 63 sufficiently on the flight bars 45 to allow the worn working layer 28 or blades 7 with the blade holder 63 to be removed and replaced with new or repaired replacements.

If is desired to completely remove the wheel 74 from the spindle 117, 118 for maintenance or other reason, once the hub 75 has been broken loose from the taper on the spindle 117, 118, the spinner 89 is rotated in the other direction a few degrees or turns by hand to loosen the locking plate 94 with respect to the heads 116 of the shoulder bolts 113. While holding the spinner 89 from rotating, the locking plate 94 is rotated to move the heads 116 into the wide portion 97 of the slots 95 and then the spinner 89 is spun with the handles 90 to remove the stub shaft 91 entirely from the opening 112 in the spindle 117, 118 and the roll retainer 88 is removed. The wheel 74 is now ready to be removed and replaced with a new or repaired wheel 74.

FIG. 7C shows a preferred modification to the embodiment shown in FIGS. 7A and 7B. This embodiment is exactly like the embodiments just described except for the shape of the bottom ends 85C of the push rods 84 and the shape of the tapered portion of the spindle 117C, 118C. In this embodiment, the ends 85C of the push rods 84 are perpendicular to the axis of the push rods 84 instead of tapered. Also, the tapered portion of the spindle 117C, 118C has a constant diameter shelf 119 for the square ends 85C of the push rods 84 to rest against when the wheel 77 is in operating position and mode. The constant diameter shelf 119 is located inboard of an outboard tapered portion 120 on the spindle 117C, 118C. This embodiment operates the same way as the embodiments shown in FIGS. 7A and 7B. Leading edges of the square ends 85C engage the outboard tapered portion 120 of the spindle 117C, 118C as the wheel 77 is moved towards its operating position by the roll retainer 88, or other tightening means. This movement causes the push rods 84 to move radially outward until they reach their operating mode at which time the square ends move onto the constant diameter shelf 119. Preferably, but not necessarily, the constant diameter shelf 119 of the tapered portion of the spindle 117C, 118C is located between a tapered portion both inboard and outboard of the shelf 119.

Figure 9A:
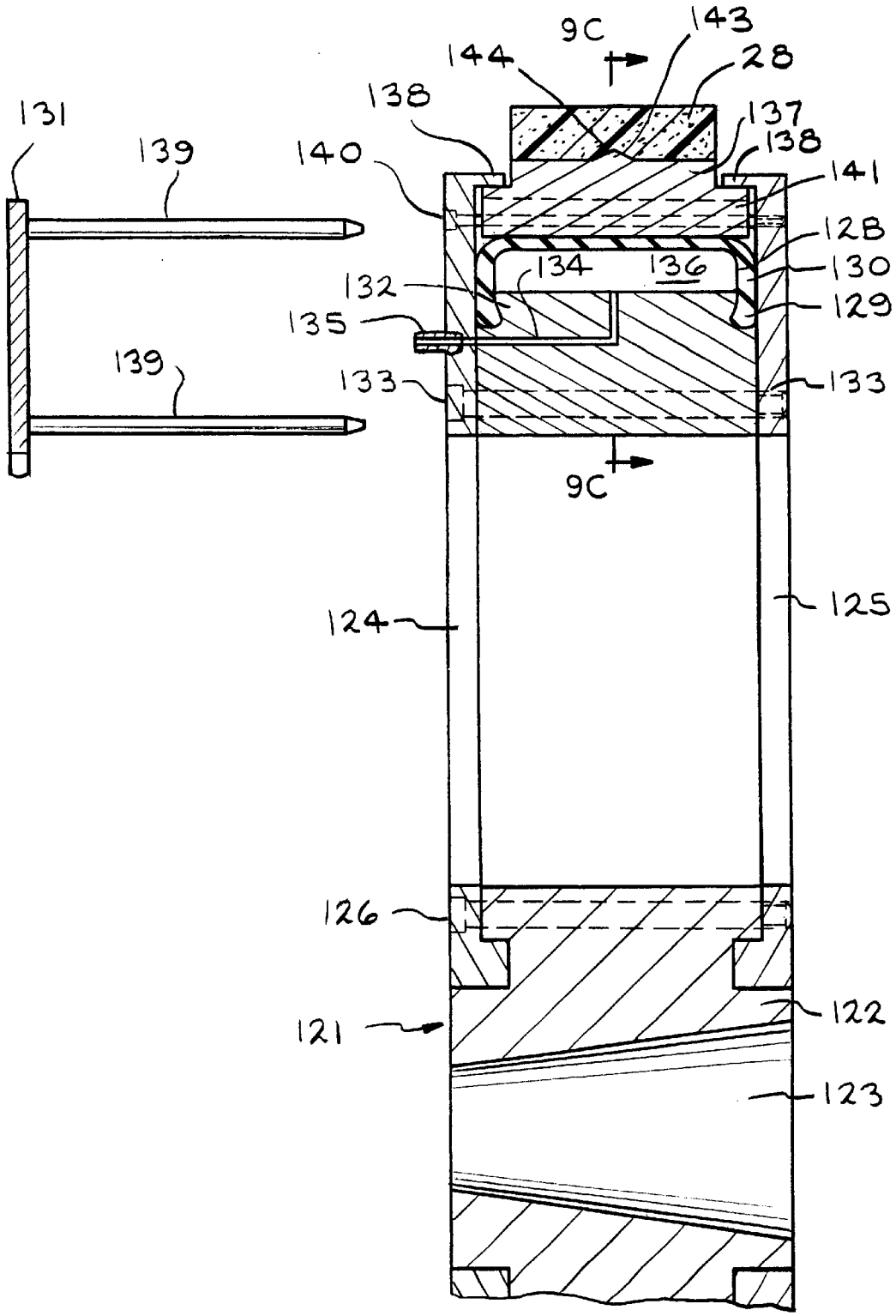
FIG. 9A is a partial cross section, taken along lines 9A—9A of FIG. 9B, of another embodiment of an inflatable/deflatable wheel according to the present invention for use in a backup roll or blade roll in the present invention.
Figure 9B:
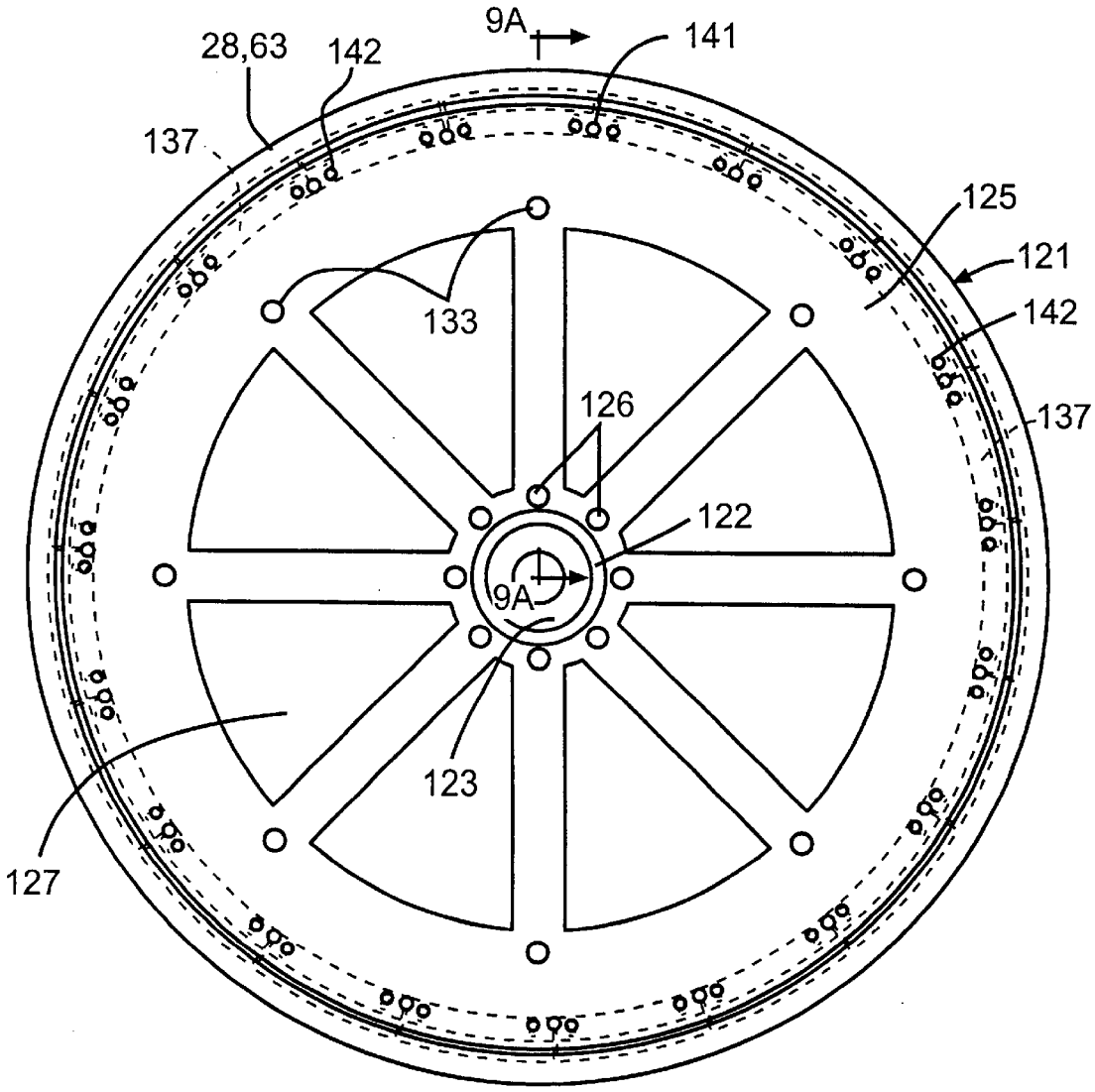
FIG. 9B is an elevational rear view of the novel backup roll shown in FIG. 9A.
Figure 9C:
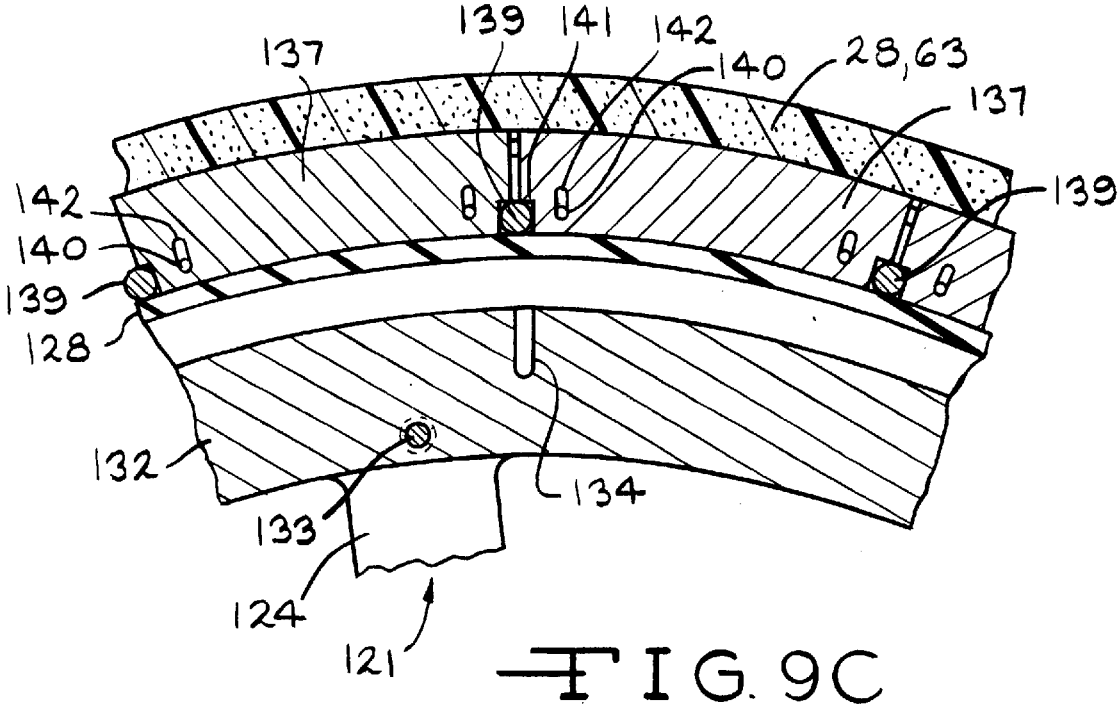
FIG. 9C is a partial rear cross sectional enlarged view of the outer peripheral portion of the wheel shown in FIGS. 9A and 9B in an inflated mode.

FIGS. 9A, 9B and 9C show a still further embodiment of an ID wheel which preferably uses a single inflatable pouch to expand flight bars and which has a different structure than the ID wheels described above. FIG. 9B is a rear elevation view of the ID wheel, FIG. 9A is a partial cross section of the ID wheel taken along lines 9A—9A in FIG. 9B and FIG. 9C is a cross section of an outer portion of the ID wheel taken along lines 9C—9C in FIG. 9A. This ID wheel comprises a hub 122, having a passageway 123, preferably tapered as shown, around its centerline for receiving either of the spindles 117 or 118 of the chopper 2. Connected to the hub 122 in any suitable manner, such as with a plurality of spaced apart bolts 126, are a front plate 124 and a back plate 125. The front plate 124 and back plate 125 can be integral with the hub 122, but it is preferable that they be separate pieces for ease of maintenance. The heads of the bolts 126 can be recessed in either the back plate 125 or preferably the front plate 124 and the threaded end of the bolt engages threads in the other plate. The front plate 124 and rear plate 125 preferably have cutouts 127 to lighten the weight of the ID wheel.

A circumferential inflatable member 128, preferably a commercially available tubeless tire as shown such as a low profile tire, resides between the outer peripheral portions of the front plate 124 and the back plate 125. Instead of a tubeless tire, a thick walled Inner Tube or any type of circumferential inflatable member can be used. The tubeless tire 128 is held with a sealing relationship by lips 129 on sidewalls 130 of the tire 128 by a circumferential rim 132, preferably secured with bolts 133 passing through the front plate 124, passing through holes in the circumferential rim 132 and threaded into the back plate 125 to make sure the axis of the circumferential rim 132 remains aligned with the axis of the hub 122 at all times.

The circumferential rim 132 has an interior passageway 134 that communicates with a chamber 136 inside the inflatable tire 128 and with a valve stem 135 located in the front plate 124 for the purpose of passing a fluid such as compressed air into and out of the chamber 136 of the inflatable tire 128. The inflatable tire 128 works with a plurality of slightly spaced apart floating flight bars 137 whose radially outward movement is limited by turned in ears 138 located on the inside of the outer peripheral edges of the front plate 124 and the back plate 125 as shown in FIG. 9A. The floating flight bars 137 are guided radially as they move radially outward and radially inward by guide pins 140 that pass through holes in the front plate 124 spaced circumferentially around the outer peripheral portion, through radial channels 142 that run completely through the floating flight bars 137, and then thread into threaded holes in the outer peripheral portion of the back plate 125 as shown in FIG. 9A.

At least some of the floating flight bars 137 preferably have sawtooth projections 146 (FIG. 13) or dimple projections 143 on their outer surface to fit into concave depressions 144 in the inner circumferential surface of the working layer 28 (or blade holder 63), as shown in detail in FIGS. 4A and 4B. Other configurations for the outer surfaces of the flight bars 137 can optionally be used as described elsewhere in this disclosure.

A keeper ring 131, similar to the keeper ring 38 shown in FIG. 5, is used with the ID wheel 121 to keep the floating flight bars 137 in a radially fixed position during operation of the chopper. Keeper pins 139 are circular in cross section to fit channels 141 located below the lower end portions of the floating flight bars 137 between the guide pins radial channels 142. The keeper pins 139 are inserted into the channels 141 after the new working surface 28 or new or repaired blade holder 63 has been properly positioned on the ID wheel 121 and after the floating flight bars 137 have been moved radially outward until they contact the ears 138 of the front plate 124 and the back plate 125 by inflating the inflatable tire 128, preferably using compressed air. Otherwise, the operation of the ID wheel 121 is identical to the operation of the ID wheel 25.

Figure 13:
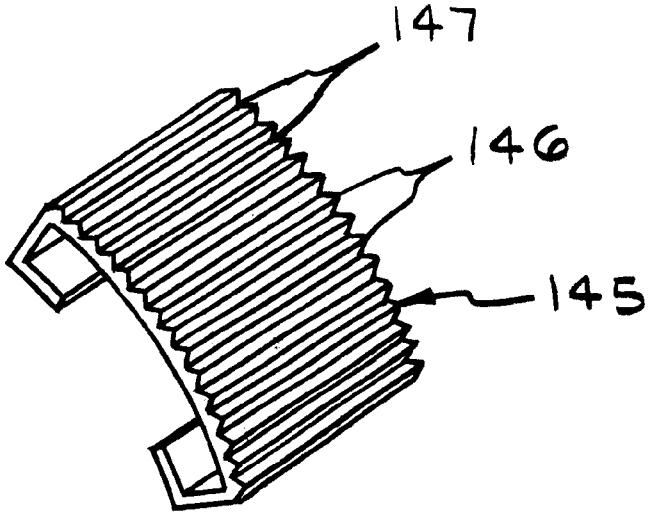
FIG. 13 is a perspective view of another embodiment of a flight bar according to the present invention.
Figure 14:
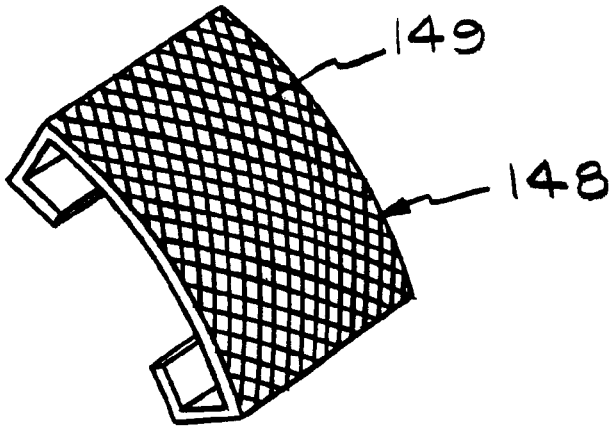
FIG. 14 is a perspective view of still another embodiment of a flight bar according to the present invention.

FIGS. 13 and 14 are perspective views of two of many types of flight bars that can be used on any of the embodiments of the present invention. These floating flight bars differ from those shown and described earlier only in the shape of their outer peripheral surfaces that engage the inner peripheral surfaces of the working layer 28 or blade holder 63 when in the operating mode of the present invention. The floating flight bar 145 shown in FIG. 13 has a plurality of ridges 146 and valleys 147 running across the outer peripheral surface of the floating flight bar 145 which, when in the operating mode, would be parallel to the axis of the spindle 117, 118. These serrations, ridges 146 and valleys 147, grip the inner periphery of the working layer 28 or blade holder 63 securely when the wheels and choppers of the present invention are operating. FIG. 14 shows a different floating flight bar 148 having a knurled outer peripheral surface 149 for holding the working layer 28 or blade holder 63 in a secure manner while the wheels and choppers of the present invention are operating. The floating flight bars used in the present invention can have on their outer peripheral surface either raised or depressed texture of many shapes, as will be well known after reading the above disclosure, for engaging either a smooth inner peripheral surface of a working layer or blade holder or a textured mating surface of such—all of which are included in the present invention.

In the rolls of the present invention that use a plurality of spaced apart flight bars, especially when the working portion of the backup roll is relatively thin such as 0.37 inch or 0.5 inch, it is preferred that the outer circumferential surface of the flight bars be almost continuous in the expanded mode to provide needed support for the relatively thin working layer. Almost continuous means that the gaps between flight bars be not more than about 0.1 inch, preferably not more than 0.05 inch and most preferably not more than about 0.03 inch. This prevents the working layer from being forced significantly into the gaps causing, at least late in the life of the working layer and/or the blades, incomplete separation of all the items passing through the chopper.

Other embodiments employing the concept and teachings of the present invention will be apparent and obvious, in the sense of 35 USC 103, to one skilled in the art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

What is claimed is:

1. A chopper for chopping items selected from the group consisting of one or more fiber, fiber strand, yarn, string, wire, ribbon, and tape, that enter the chopper in an unwound form, into an array of short lengths, the chopper comprising a frame supporting a blade roll mounted on a first spindle and containing a set of spaced apart blades mounted in a blade holder on the outer periphery of the blade roll, a backup roll mounted on a second spindle and having a working surface layer on its outer periphery, the improvement comprising that either the blade roll, the backup roll or both are wheels having a working surface or a blade holder mounted on their outer peripheral surface, each wheel being expandable and retractable radially on at least an outboard side to permit a worn working surface or the blade holder to be replaced with a fresh working surface or blade holder as an outer periphery of the wheel or wheels without having to completely remove either wheel from the spindle or spindles, said wheel or wheels also comprising a mechanical stop that prevents said wheel or wheels from retracting during operation of the chopper.

2. The chopper of claim 1 wherein the wheel or wheels comprise a mechanical mechanism that retracts or expands outer peripheral parts away from and against the working surface and/or the blade holder.

3. The chopper of claim 1 wherein the wheel or wheels comprise at least one inflatable and deflatable pouch for expanding and retracting the wheel or wheels.

4. The chopper of claim 3 wherein the wheel or wheels comprise a plurality of inflatable and deflatable pouches.

5. A chopper for chopping items selected from the group consisting of one or more fiber, fiber strand, yarn, string, wire, ribbon, and tape, that enter the chopper in an unwound form, into an array of short lengths, the chopper comprising a frame supporting a blade roll mounted on a first spindle and containing a set of spaced apart blades mounted in a blade holder on the outer periphery of the blade roll, a backup roll mounted on a second spindle and having a working surface layer on its outer periphery, the improvement comprising that either the blade roll, the backup roll or both are wheels having a working surface or a blade holder mounted on their outer peripheral surface, each wheel comprising a mechanical mechanism for expanding and retracting radially on at least an outboard side of the wheel or wheels to permit the worn working surface or the blade holder to be replaced with a fresh working surface or blade holder as an outer periphery of the wheel or wheels without having to completely remove either wheel from the spindle or spindles, said wheel or wheels also comprising a mechanical stop that prevents said wheel or wheels from retracting during operation of the chopper.

6. The chopper of claim 5 wherein the wheel also comprises a plurality of radially movable flight bars spaced around the outer peripheral portion of the wheel.

7. The chopper of claim 6 wherein the wheel also comprises radially movable rods that cause the flight bars to move against the working layer or blade holder when the wheel is put into operating position on the chopper.

8. A chopper for chopping items selected from the group consisting of one or more fiber, fiber strand, yarn, string, wire, ribbon, and tape, that enter the chopper in an unwound form, into an array of short lengths, the chopper comprising a frame supporting a blade roll mounted on a first spindle and containing a set of spaced apart blades mounted in a blade holder on the outer periphery of the blade roll, a backup roll mounted on a second spindle and having a working surface layer on its outer periphery, the improvement comprising that either the blade roll, the backup roll or both are wheels having a working surface or a blade holder mounted on their outer peripheral surface, each wheel comprising at least one inflatable and deflatable pouch which expands and retracts said outer peripheral surface radially on at least an outboard side of the wheel or wheels to permit a worn working surface or the blade holder to be replaced with a fresh working surface or fresh blade holder as an outer periphery of the wheel or wheels without having to completely remove either wheel from the spindle or spindles, said wheel or wheels also comprising a mechanical stop that prevents said wheel or wheels from retracting during operation of the chopper.

9. The chopper of claim 8 wherein the wheel or wheels comprise a plurality of said pouches.

10. A method of chopping items selected from the group consisting of one or more fiber, fiber strand, yarn, string, wire, ribbon, and tape, that enter the chopper in an unwound form, into an array of short lengths, comprising feeding one or more of the items into a chopper comprising a frame supporting a blade roll mounted on a first spindle and containing a set of spaced apart blades mounted in a blade holder on the outer periphery of the blade roll, a backup roll mounted on a second spindle and having a working surface layer on its outer periphery, whereby the one or more items are Dulled into a nip between said backup roll and said blade roll and are separated into short lengths, the improvement comprising that either the blade roll, the backup roll or both are wheels having a working surface or a blade holder mounted on their outer peripheral surface, each wheel being expandable and retractable radially on at least an outboard side to permit a worn working surface or the blade holder to be replaced with a fresh working surface or blade holder as an outer periphery of the wheel or wheels without having to completely remove either wheel from the spindle or spindles, said wheel or wheels also comprising a mechanical stop that prevents said wheel or wheels from retracting during operation of the chopper.

11. The method of claim 10 wherein the wheel or wheels comprise a mechanical mechanism that retracts or expands outer peripheral parts radially away from and against the working surface and/or the blade holder.

12. The method of claim 10 wherein the wheel or wheels comprise at least one inflatable and deflatable pouch for expanding and retracting the wheel or wheels radially.

13. The method of claim 12 wherein the wheel or wheels comprise a plurality of inflatable and deflatable pouches for expanding and retracting said wheel or wheels radially.

14. The method of claim 10 wherein the mechanical stop comprises a plurality of pins mounted on a curved member, that when installed in said wheel or wheels prevents said wheel or wheels from retracting radially during operation of the chopper.

* * * * *